US008201763B2

(12) United States Patent
Yamada et al.

(10) Patent No.: US 8,201,763 B2
(45) Date of Patent: Jun. 19, 2012

(54) SELF-PROPELLED CRUSHING SYSTEM

(75) Inventors: Mitsunobu Yamada, Hirakata (JP); Toshimasa Kanda, Tachikawa (JP); Hiroyuki Umeda, Ibaraki (JP); Koya Iizuka, Kawagoe (JP); Masaru Nakamura, Hirakata (JP); Masaaki Uetake, Hirakata (JP)

(73) Assignee: Komatsu Ltd, Tokyo (JP)

( * ) Notice: Subject to any disclaimer, the term of this patent is extended or adjusted under 35 U.S.C. 154(b) by 194 days.

(21) Appl. No.: 12/597,552

(22) PCT Filed: Apr. 11, 2008

(86) PCT No.: PCT/JP2008/057159

§ 371 (c)(1),
(2), (4) Date: Oct. 26, 2009

(87) PCT Pub. No.: WO2008/136252

PCT Pub. Date: Nov. 13, 2008

(65) Prior Publication Data

US 2010/0116919 A1 May 13, 2010

(30) Foreign Application Priority Data

| | | |
|---|---|---|
| Apr. 27, 2007 | (JP) | 2007-120150 |
| Apr. 27, 2007 | (JP) | 2007-120151 |
| Apr. 27, 2007 | (JP) | 2007-120152 |
| Apr. 27, 2007 | (JP) | 2007-120153 |
| May 8, 2007 | (JP) | 2007-123998 |

(51) Int. Cl.
*B02C 19/20* (2006.01)
*B02C 9/04* (2006.01)

(52) U.S. Cl. ..... 241/101.741; 241/101.75

(58) Field of Classification Search ..... 241/101.74, 241/101.741, 101.742, 101.75, 101.76, 101.761, 241/101.762, 101.763
See application file for complete search history.

(56) References Cited

U.S. PATENT DOCUMENTS

| | | | | |
|---|---|---|---|---|
| 3,563,477 | A * | 2/1971 | Schroeder et al. | 241/101.76 |
| 5,460,332 | A * | 10/1995 | Frick | 241/101.74 |
| 5,647,545 | A * | 7/1997 | Conner | 241/79 |
| 5,921,706 | A * | 7/1999 | Manatt et al. | 404/72 |
| 6,957,822 | B2 * | 10/2005 | Douglas et al. | 280/416.1 |
| 2006/0202073 | A1 | 9/2006 | Heezel et al. | |

(Continued)

FOREIGN PATENT DOCUMENTS

EP 0327678 * 8/1989

(Continued)

OTHER PUBLICATIONS

International Search Report and Written Opinion of the International Searching Authority dated Nov. 10, 2009 (5 pages), issued in counterpart International Application No. PCT/JP2008/057159.

*Primary Examiner* — Faye Francis
(74) *Attorney, Agent, or Firm* — Holtz, Holtz, Goodman & Chick, PC

(57) ABSTRACT

A mobile crushing system is for crushing inputted objects and dropping the crushed objects directly into an ore path. The mobile crushing system includes a crusher vehicle on which a crushing device for crushing the objects is mounted and which includes carriers, and a feeder vehicle on which a transfer device for transferring the objects to the crushing device and which includes carriers. The crusher vehicle and the feeder vehicle travel independently and include a crusher-side connecting portion and a feeder-side connecting portion that are connected to each other. During crushing operation, the ore path is interposed between the crusher vehicle and the feeder vehicle in the front-rear direction.

14 Claims, 21 Drawing Sheets

U.S. PATENT DOCUMENTS

2008/0302894 A1* 12/2008 Douglas et al. ..... 241/101.74

FOREIGN PATENT DOCUMENTS

| | | | |
|---|---|---|---|
| JP | 56-106844 | | 1/1955 |
| JP | 52-154167 | | 12/1977 |
| JP | 56-73555 | A | 6/1981 |
| JP | 2000-136739 | A | 5/2000 |
| JP | 2004-223319 | A | 8/2004 |
| JP | 2006-110415 | A | 4/2006 |
| JP | 2007-144255 | A | 6/2007 |

* cited by examiner

SELF-PROPELLED CRUSHING SYSTEM

This application is a U.S. National Phase Application under 35 USC 371 of International Application PCT/JP2008/057159 filed Apr. 11, 2008.

TECHNICAL FIELD

The present invention relates to a mobile crusher that is movably installed, for example, in tunnels in a mine.

As shown in FIG. 20, tunnels A extending horizontally are typically connected to mining points 500 under the ground. Tunnels A1 vertically adjacent to each other are connected via connecting tunnels A2 that extend upward and downward. Ore paths (ore input openings) B into which ores are dropped are provided on the tunnels A1. The ore paths B are combined together so that a fixed crusher (not shown) is provided in the vicinity of the exit of the combined ore path. Ores crushed by the fixed crusher are temporarily stored in a reservoir 501. The ores stored in the reservoir 501 are dropped into a bucket 503 via a conveyor 502 provided on a lower portion of the reservoir 501 for every predetermined amount, and are pulled up by the bucket 503 to the ground.

In recent years, the mining points 500 are not only vertically provided at plural positions, but also provided planarly at plural positions. In such mining points 500, tunnels A3 and A4 are provided in a net-like pattern, and ore paths B are provided at positions slightly recessed from a straight tunnel A5 separated from the mining points 500. A fixed crusher 504 is provided on the ore paths B. Alternatively, such ore paths B may be provided in the tunnels A4 or A5.

In underground mines shown in FIGS. 21 and 22, quarrying is conducted by loaders 505 each having an articulate mechanism. Ores quarried by the loaders 505 are conveyed through the tunnels A3, A4 and A5 by the loaders 505, and then dropped into the fixed crusher 504 to be crushed. The crushed ores are discharged at a predetermined position by a conveyer 502 disposed directly below the ore paths B, and then pulled up from the predetermined position to the ground.

When quarrying in the vicinity of one of the ore paths B is finished in the underground mines shown in FIGS. 21 and 22, quarrying in the vicinity of another ore path B is started. The fixed crusher 504 needs to be moved every time a place to be quarried is changed from the vicinity of one of the ore paths B to the vicinity of another ore path B, thus causing cumbersome work. Accordingly, there has been demand to use a mobile crusher instead of the fixed crusher 504.

Typically, a mobile crusher including carriers is used in a mining point having a large working space (Patent Document 1). However, such a mobile crusher is tall, so that it is difficult to install the mobile crusher at a mining point having a limited working space such as a tunnel in an underground mine. Thus, it has been suggested that, in a mobile crusher, a transfer device for transferring objects to be crushed to a crushing device is mounted on a vehicle body such that the transfer device is downwardly inclined, and a hopper is provided corresponding to the downwardly-inclined portion of the transfer device (Patent Document 2). Since the hopper is provided at a low position according to such an arrangement, the height of the mobile crusher can be reduced as a whole and thus the mobile crusher can be installed in a space having a height limit such as a tunnel.

[Patent Document 1] JP-A-2006-110415

[Patent Document 2] JP-A-2004-223319

DISCLOSURE OF THE INVENTION

Problems to be Solved by the Invention

However, even when the mobile crusher disclosed in Patent Document 2 is used, the mobile crusher including the hopper, the transfer device, the crushing device and a power line for driving various devices is still too long as a whole. Accordingly, the turning radius of the mobile crusher is increased when the mobile crusher is moved in tunnels. When narrow tunnels are provided in a net-like pattern in an underground mine, the mobile crusher cannot easily turn at intersections (turn right and turn left) of the tunnels.

Specifically, most of the tunnels A3, A4 and A5 do not intersect one another at right angles as shown in FIG. 21. Most of the tunnels A3, A4 and A5 intersect one another at obtuse angles when the mobile crusher turns right or left. In other words, when an intersection has an obtuse-angled corner on one side, the intersection inevitably has an acute-angled corner on the other side. The mobile crusher can turn at the obtuse-angled corner, but mobile crusher cannot turn at the acute-angled corner. Accordingly, the mobile crusher needs to enter the tunnel A3 or A4 backward after passing by the obtuse-angled corner, or needs to go the long way around by only turning at the obtuse-angled corners.

Further, since the width and height of the tunnel A3, A4 or A5 are minimally reduced, it is difficult for the mobile crusher to make a turn quickly even at the obtuse-angled corners. As a matter of course, not only when making a turn but also when moving in the straight tunnels A4 and A5, the mobile crusher needs to move in a narrow space anyway. Thus, the mobile crusher capable of moving more smoothly has been desired.

JP-A-56-73555 (see FIG. 14) discloses a crushing plant in which a vehicle on which a crushing device is mounted and a vehicle on which a transfer device is mounted can be separated. However, such a crushing plant is too tall and thus cannot move freely in tunnels. Also, it is difficult to accurately position the transfer device relative to the crushing device, thus taking considerable time to start crushing operation.

An object of the invention is to provide a mobile crusher capable of easily moving in narrow tunnels with corners.

Means for Solving the Problems

According to an aspect of the invention, a mobile crusher that crushes inputted objects and drops the crushed objects directly into an ore path includes: a crusher vehicle on which a crushing device for crushing the objects is mounted, the crusher vehicle including carriers; and a feeder vehicle on which a transfer device for transferring the objects to the crushing device is mounted, the feeder vehicle including carriers, in which the crusher vehicle and the feeder vehicle travel independently and include a crusher-side connecting portion and a feeder-side connecting portion connected to each other, the crusher vehicle and the feeder vehicle being disposed anteriorly and posteriorly to the ore path during crushing operation.

Since the mobile crusher includes the crusher vehicle and the feeder vehicle that travel independently according to the aspect of the invention, the entire length of each vehicle can be sufficiently reduced and thus the turning radius can be reduced. Accordingly, the mobile crusher can favorably turn at intersections in tunnels in an underground mine. Also, since the crusher vehicle and the feeder vehicle include the crusher-side connecting portion and the feeder-side connecting portion, the crusher vehicle and the feeder vehicle can be accurately positioned by connecting the crusher-side connecting portion to the feeder-side connecting portion during crushing operation. Thus, the objects conveyed from the transfer device can be reliably inputted into the crushing device and therefore the crushing operation can be favorably conducted.

In the mobile crusher according to the aspect of the invention, it is preferable that a transferring hydraulic motor that drives the transfer device is provided in the feeder vehicle and a transferring hydraulic pump that supplies hydraulic pressure to the transferring hydraulic motor is provided in the crusher vehicle.

Since a hydraulic source for driving the transfer device of the feeder vehicle is supplied from the crusher vehicle according to the above arrangement, a driving source for the transfer device does not need to be provided on the feeder vehicle, thereby downsizing the feeder vehicle. Further, necessary operation can be conducted in the feeder vehicle without driving an engine.

In the mobile crusher according to the aspect of the invention, it is preferable that a chute is provided between the crusher vehicle and the feeder vehicle and is attached to either one of the crusher vehicle and the feeder vehicle and the chute extends from a lower portion of the transfer device toward the ore path.

Since the chute extending from the lower portion of the transfer device toward the ore path is provided on the crusher vehicle or the feeder vehicle according to the above arrangement, foulings adhered to the transfer device can be guided to the ore path by the chute when the foulings are dropped. The above arrangement is favorable especially when the foulings are treated as crushed objects.

In the mobile crusher according to the aspect of the invention, it is preferable that a positioning unit is provided on the crusher-side connecting portion and the feeder-side connecting portion for positioning the crusher vehicle and the feeder vehicle.

Since the positioning unit is provided on the crusher-side connecting portion and the feeder-side connecting portion according to the above arrangement, the crusher vehicle and the feeder vehicle can be easily positioned when being connected to each other.

In the mobile crusher according to the aspect of the invention, it is preferable that the positioning unit includes: a guide pin provided on either one of the crusher-side connecting portion and the feeder-side connecting portion and protruding toward the other one; and a guide hole provided on the other one, the guide pin being inserted into the guide hole.

In the mobile crusher according to the aspect of the invention, it is preferable that the positioning unit includes a light-emitting device provided on either one of the crusher-side connecting portion and the feeder-side connecting portion for emitting light toward the other one and a target portion provided on the other one for receiving the light emitted from the light-emitting device.

In the mobile crusher according to the aspect of the invention, it is preferable that the feeder vehicle includes the carriers on right and left sides, and the transfer device is positioned so that its base end close to an input port of the objects is positioned as high as the carriers, the transfer device being inclined upwardly toward a distal end thereof.

Since the transfer device is positioned so that its base end close to the input port of the objects is positioned at a lower portion between the carriers according to the above arrangement, the objects to be crushed can be reliably inputted into the transfer device even at a limited working space. Accordingly, the feeder vehicle suitable for the mobile crusher can be provided.

In the mobile crusher according to the aspect of the invention, it is preferable that the feeder vehicle includes a body frame, and the transfer device is rotatably pivoted on the body frame by a rotary shaft horizontally orthogonal to the front-rear direction, the transfer device being connected to the body frame via a lift cylinder.

Since the transfer device is rotated by extending and retracting the lift cylinder according to the above arrangement, the transfer device is rotated and laid down to be substantially horizontal in the front-rear direction for moving, so that the entire height of the feeder vehicle can be reduced during movement.

In the mobile crusher according to the aspect of the invention, it is preferable that the feeder vehicle includes: a traveling hydraulic motor that drives the carriers; a traveling hydraulic pump for supplying hydraulic pressure to the traveling hydraulic motor and the lift cylinder; and an engine that drives the traveling hydraulic pump. It is further preferable that the engine is provided between the carries provided on the right and left sides, and at least two of a fuel tank for storing fuel for the engine, a hydraulic oil tank for storing hydraulic oil compressively transferred to the traveling hydraulic motor and the lift cylinder, a control panel and a battery are separately provided on upper portions of the carriers on the right and left sides.

Since the engine is disposed between the carriers on the right and left sides, i.e., the lower portion of the transfer device, and many of other devices are separately disposed on the upper portions of the carriers on the right and left sides, the transfer device and the devices including the engine do not interfere with each other even when the rotatable transfer device is laid down. Accordingly, the transfer device can be reliably laid down so that the height of the feeder vehicle can be sufficiently reduced. Also, maintenance of the engine, fueling of the tank and the like, operation on the control panel and check on the battery can be conducted without difficulty.

In the mobile crusher according to the aspect of the invention, it is preferable that, in the feeder vehicle, at least two of the fuel tank for storing fuel for the engine, the hydraulic oil tank for storing hydraulic oil compressively transferred to the traveling hydraulic motor, the control panel and the battery are separately provided on the upper portions of the carriers on the right and left sides, and eaves that cover devices disposed on the upper portions of the carriers are provided on a hopper at a position close to the input port of the objects of the transfer device.

Since various devices are separately disposed on the upper portions of the carriers on the right and left sides according to the above arrangement, the transfer device can be disposed at a low position and thus the height of the feeder vehicle can be sufficiently reduced. Also, since the eaves are provided on the hopper and the devices disposed on the upper portions of the carries are guarded by the eaves, the devices can be protected from falling objects without hindering the movement of the feeder vehicle and the crushing operation.

In the mobile crusher according to the aspect of the invention, it is preferable that the eaves are integrated with the hopper on the right and left sides and at least the eaves partially are inclined downwardly as extending outwardly on the right and left sides.

Since the eaves are inclined according to the above arrangement, the eaves can be shaped to conform to a ceiling of a haulageway or tunnel in which the feeder vehicle travels. Thus, mobility is not deteriorated.

In the mobile crusher according to the aspect of the invention, it is preferable that the crusher vehicle includes a jaw crusher as the crushing device, a discharge port of the jaw crusher is positioned lower than the lowermost surface of a body frame on which the jaw crusher is mounted, an upper portion of a flywheel provided on the jaw crusher is positioned lower than an upper end of a swing jaw of the jaw crusher, and the jaw crusher is disposed so that a tooth flank of a fixed jaw is vertical to the body frame.

According to the above arrangement, the jaw crusher is disposed so that the discharge port is provided at the low position and is laid down, and the diameter of the flywheel is reduced such that the flywheel does not protrude upward further than the swing jaw. Thus, the height of the crushing device can be considerably reduced and the crushing device does not rub against ceilings in tunnels, thereby enhancing mobility. Accordingly, the crusher vehicle suitable for the mobile crusher can be provided.

In the mobile crusher according to the aspect of the invention, it is preferable that the crusher vehicle includes a crushing hydraulic motor that drives the jaw crusher.

Since the jaw crusher is hydraulically driven according to the above arrangement, the swing jaw can be driven by a large torque. Thus, inertial force of the flywheel is not necessary and therefore the diameter of the flywheel can be reliably reduced.

In the mobile crusher according to the aspect of the invention, it is preferable that the crusher vehicle includes: a crushing hydraulic pump for supplying hydraulic pressure to the crushing hydraulic motor; an electric motor that drives the crushing hydraulic pump; a traveling hydraulic motor that drives the carriers of the crusher vehicle; a traveling hydraulic pump for supplying hydraulic pressure to the traveling hydraulic motor; and an engine that drives the traveling hydraulic pump.

Since the jaw crusher used for crushing operation is driven by hydraulic pressure generated by the electric motor and the carriers used for traveling are driven by hydraulic pressure generated by the engine according to the above arrangement, the electric motor is not used during travelling. Accordingly, a power cable does not need to be dragged during traveling. Thus, a reel for winding a long power cable is not necessary, thereby further downsizing the crusher vehicle and considerably enhancing mobility.

In the mobile crusher according to the aspect of the invention, it is preferable that a cooling unit that cools hydraulic oil for driving the crushing hydraulic motor is provided on the crusher vehicle, and at least the cooling unit is provided close to a center of the crusher vehicle in a width direction thereof.

Since a cooling fan and the like included in the cooling unit for cooling hydraulic oil are large, the cooling unit is tall as a whole. Accordingly, the tall cooling unit is disposed at the center according to the above arrangement. Thus, the cooling unit can be positioned below the tallest portion of a ceiling that is curved in a tunnel and thus can be prevented from rubbing against the ceiling.

According to another aspect of the invention, a mobile crusher includes: a vehicle body on which a crushing device is mounted, the vehicle body including carriers; a feeder unit provided on one of front and rear ends of the vehicle body; and a power unit provided on the other end, in which a swing unit that horizontally swings at least one of the feeder unit and the power unit relative to the vehicle body while the carriers travel is provided between the vehicle body and the at least one of the feeder unit and the power unit.

Since the swing unit is provided between the vehicle body and the feeder unit or the power unit according to the above arrangement, the feeder unit or the power unit can swing right and left relative to the vehicle body. The turning radius of the mobile crusher can be reduced when the feeder unit or the power unit swings. The mobile crusher can turn even at narrow intersections of tunnels by swinging the feeder unit or the power unit, thus facilitating the movement in the tunnels.

In the mobile crusher according to the aspect of the invention, it is preferable that the swing unit is provided at least between the vehicle body and the feeder unit.

Since the feeder unit that is long in the front-rear direction is swingably provided to the mobile crusher according to the above arrangement, the turning radius can be reliably and effectively reduced. Further, since only hydraulic and electric lines for driving the feeder unit are connected to the vehicle body (power unit), the number of lines required to be flexible for swinging the feeder unit can be reduced. Thus, an arrangement in the vicinity of the swing unit can be simplified.

It is preferable that the mobile crusher according to the aspect of the invention further includes a slide mechanism that slides the crushing device in a front-rear direction.

Since the slide mechanism is provided according to the above arrangement, the crushing device can be slid to be spaced away from the feeder unit. Thus, the feeder unit can swing without interference with the crushing device. During crushing operation, the feeder unit is disposed so that the distal end thereof is positioned above the crushing device while overlapping the crushing device as viewed from the above because it is required to transfer the objects into the crushing device. When the feeder unit swings in such a posture during movement, the feeder unit may interfere with the crushing device. According to the aspect of the invention, such interference can be reliably prevented.

BEST MODE FOR CARRYING OUT THE INVENTION

First Exemplary Embodiment

A first exemplary embodiment of the invention will be described below with reference to the attached drawings.

Figure 1:
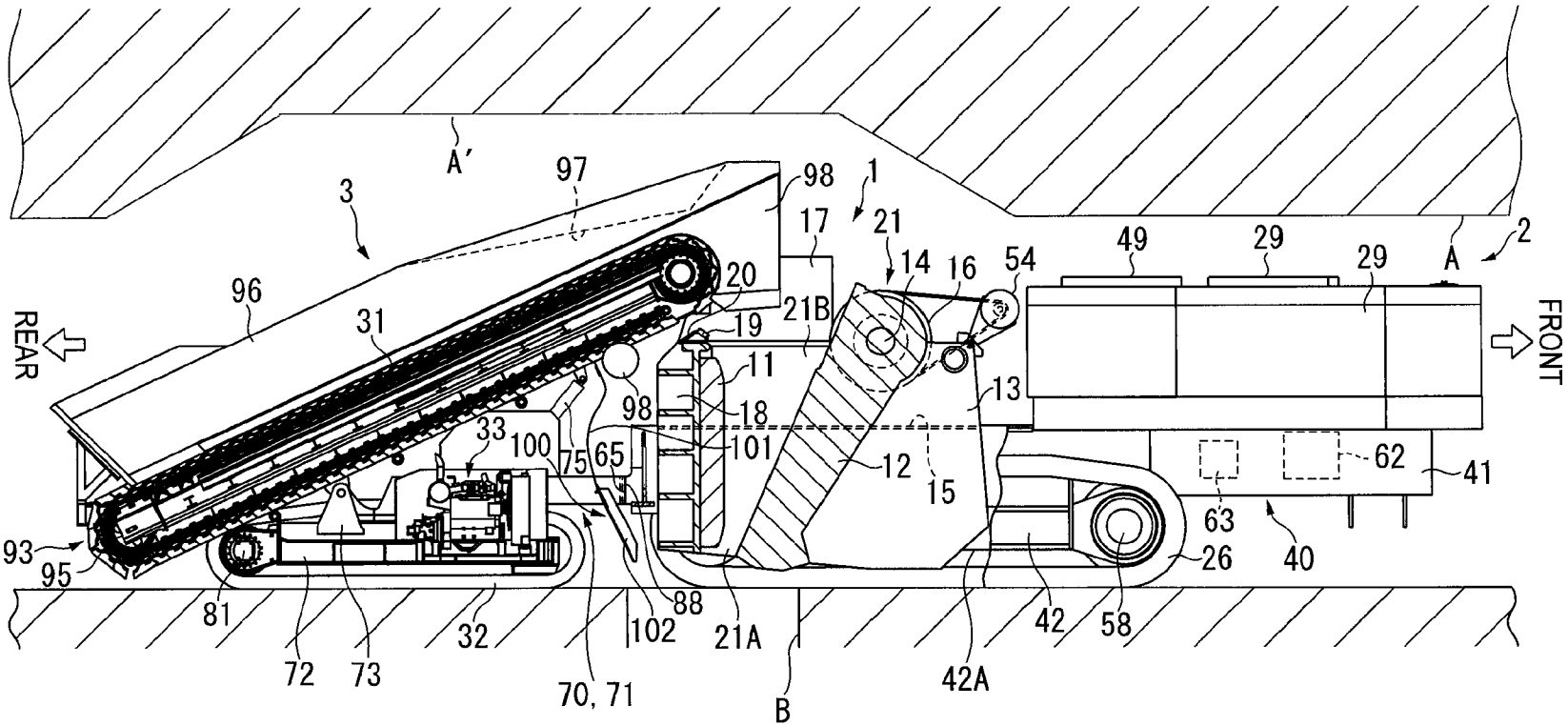
FIG. 1 shows a mobile crusher during operation, which is also a cross sectional view taken along line I-I in FIG. 2, according to a first exemplary embodiment of the invention.
Figure 2:
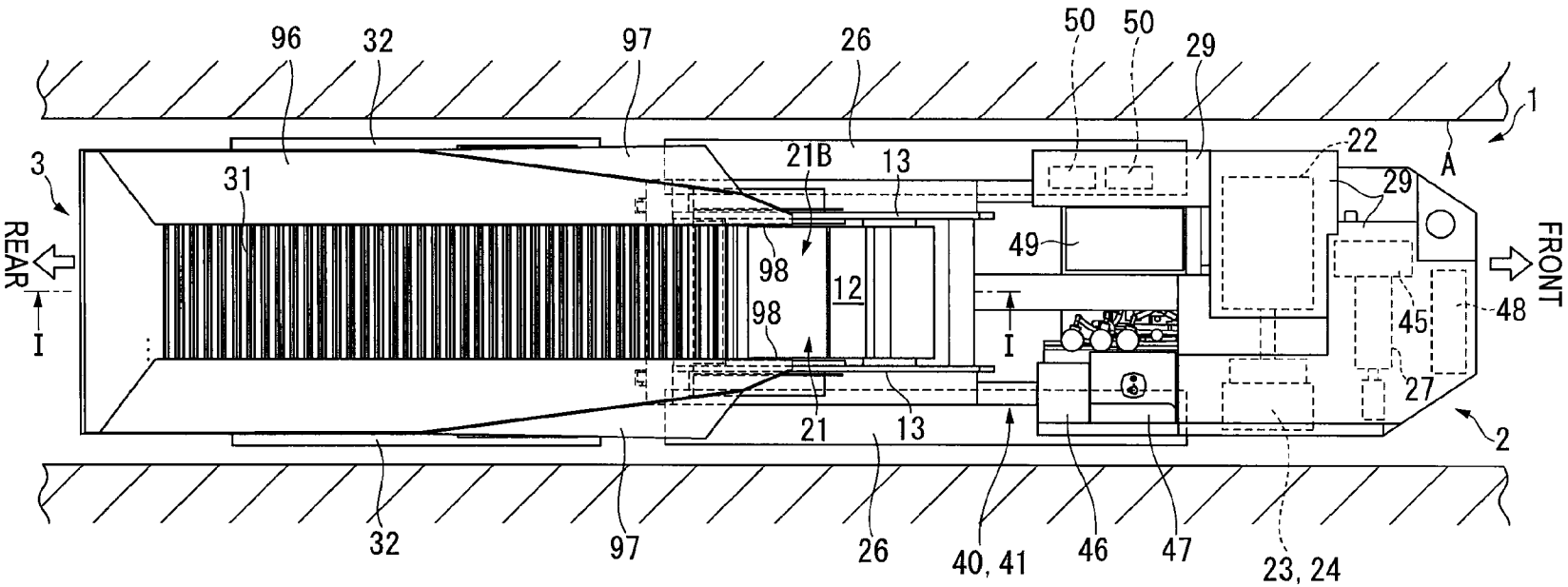
FIG. 2 is a plan view showing the mobile crusher.
Figure 3:
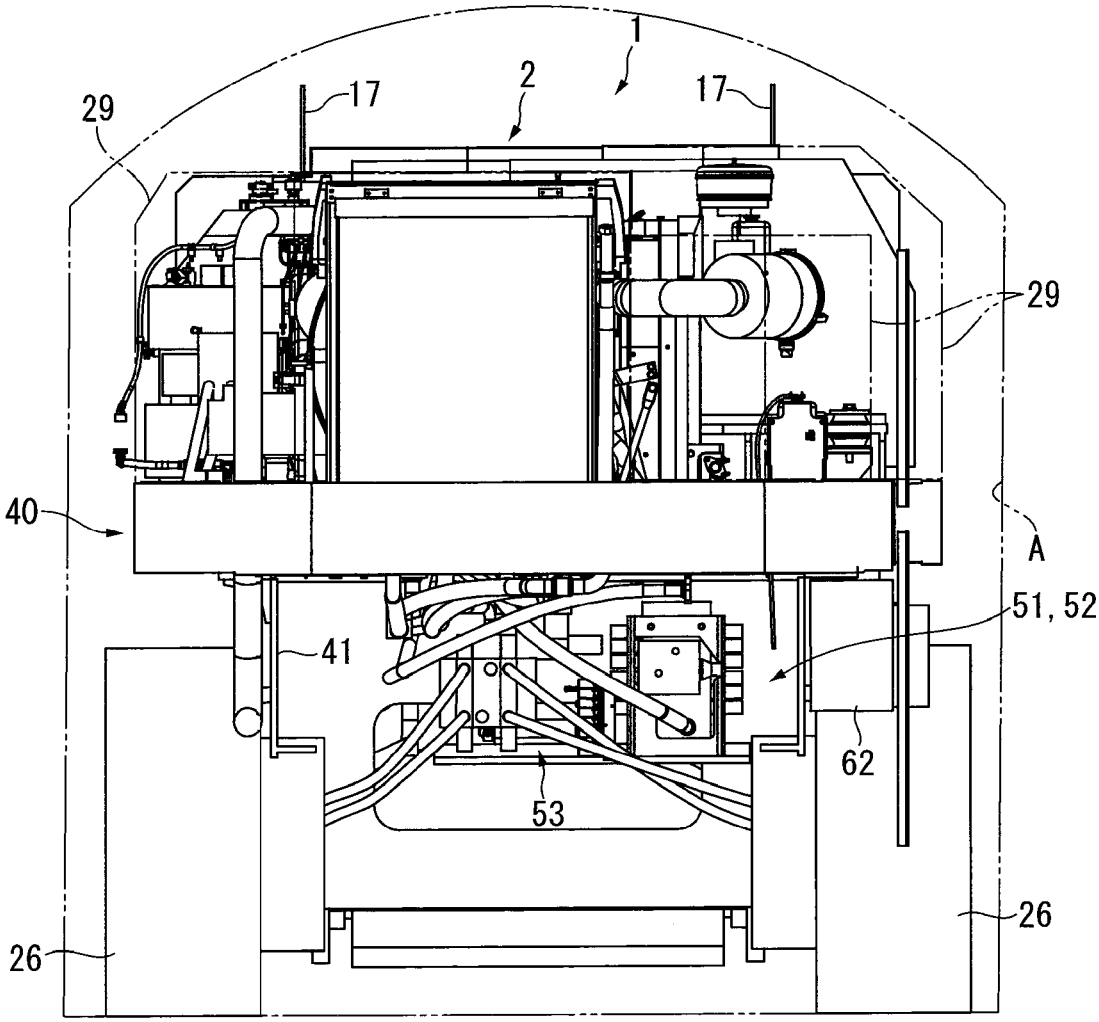
FIG. 3 shows a crusher vehicle of the mobile crusher as viewed from a front side.
Figure 4:
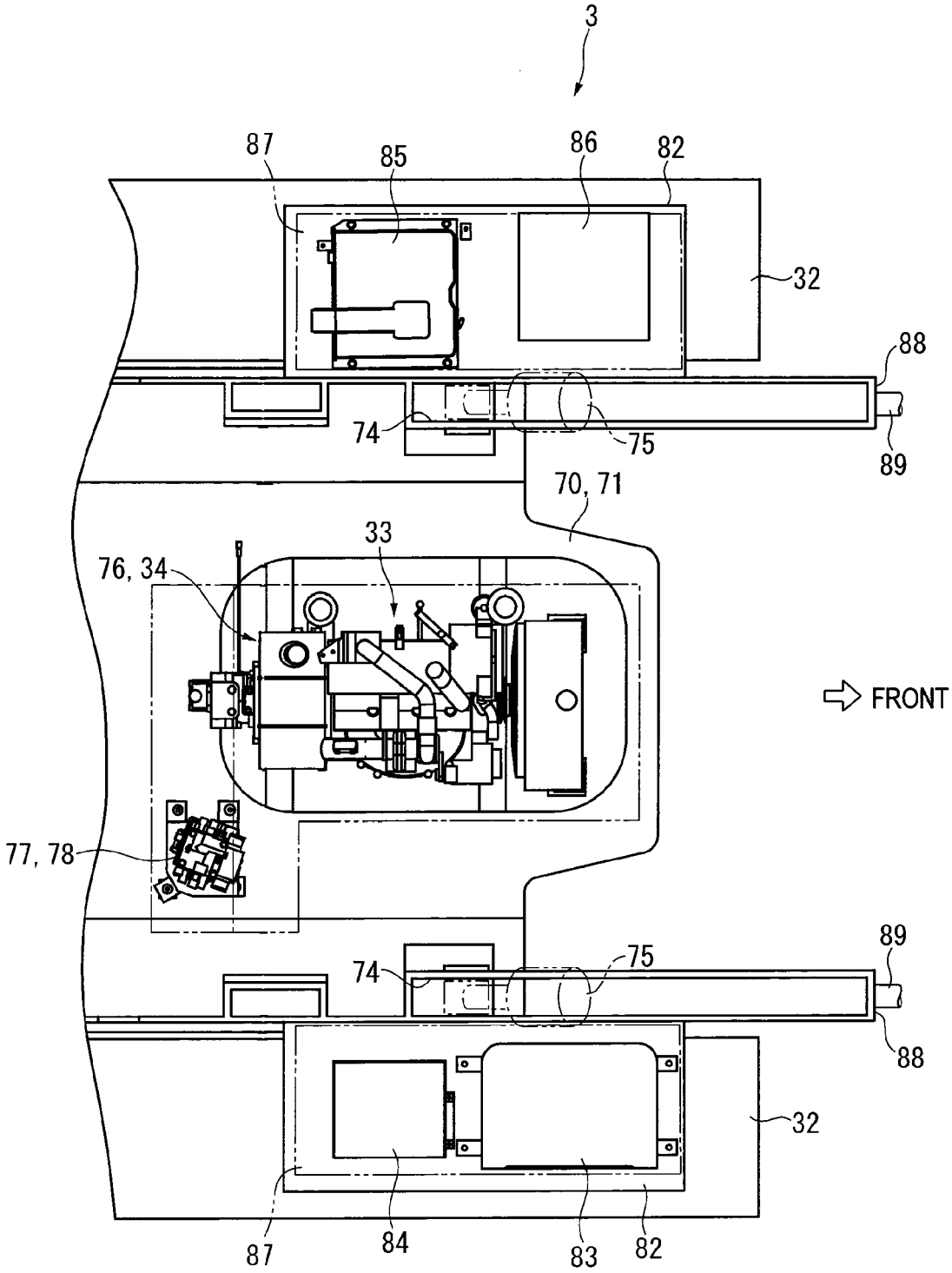
FIG. 4 is a plan view showing a front portion of a feeder vehicle of the mobile crusher.
Figure 5:
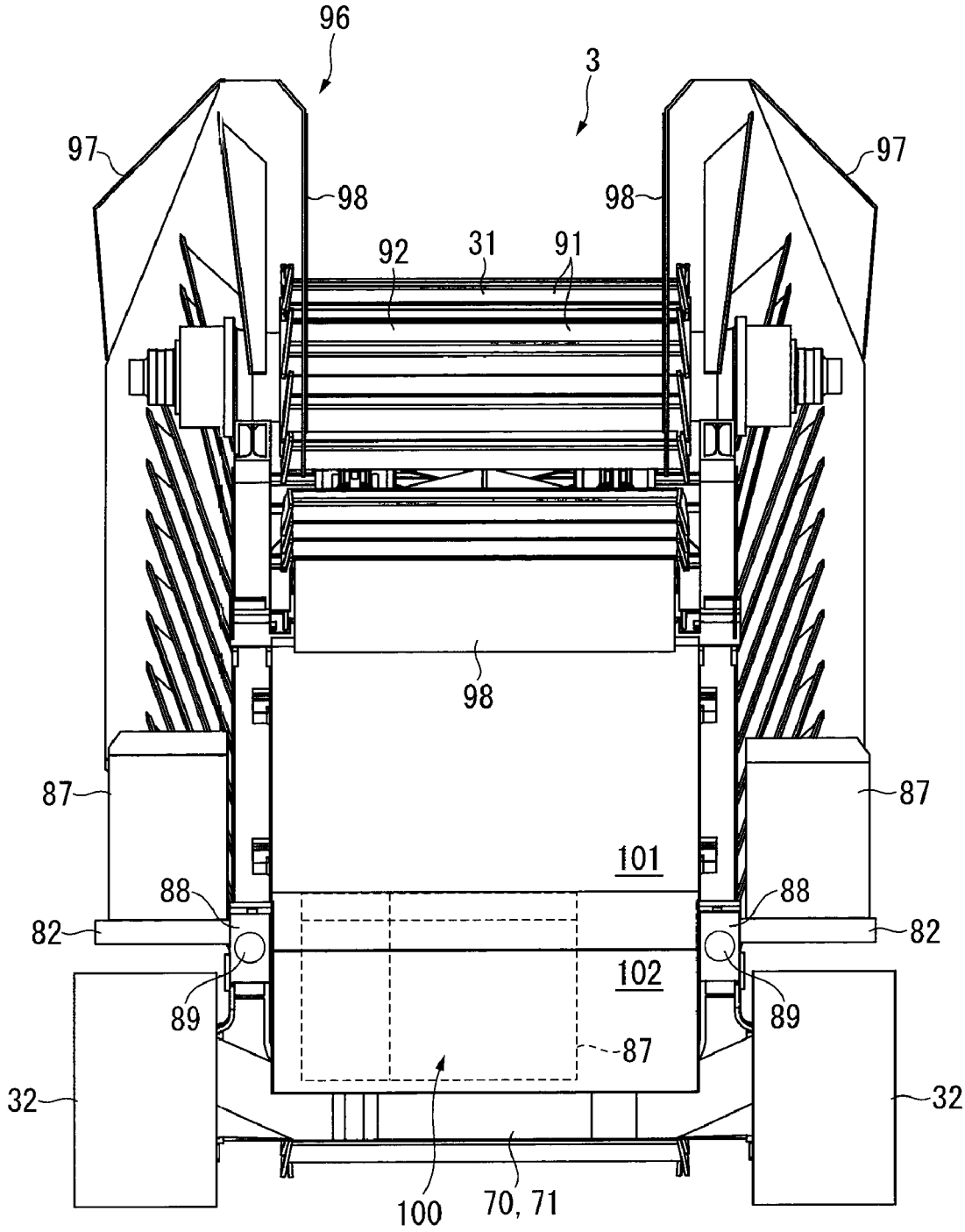
FIG. 5 shows the feeder vehicle as viewed from the front side.
Figure 6:
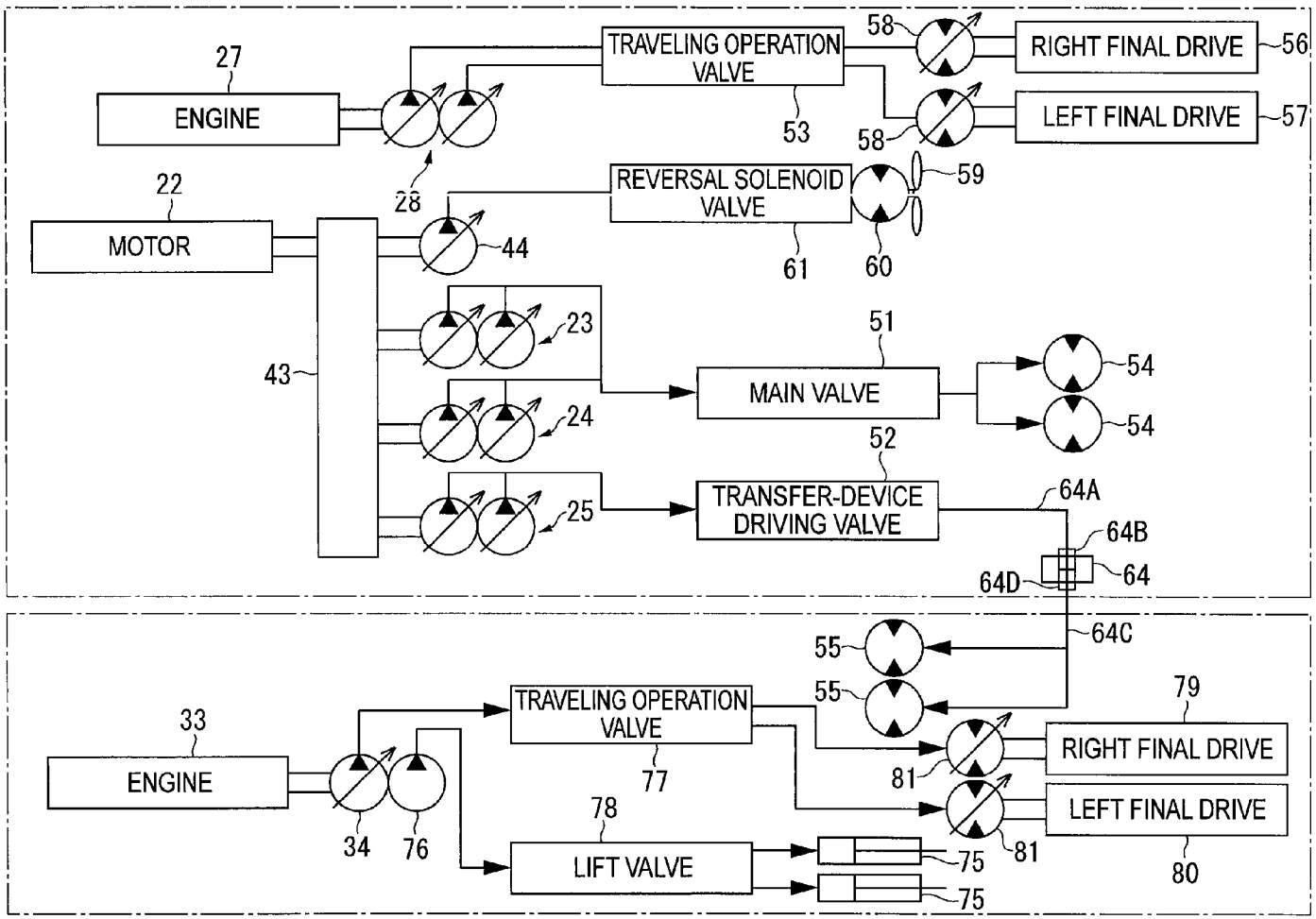
FIG. 6 shows a hydraulic circuit used for the mobile crusher.

FIG. 1 shows a mobile crusher 1 of the first exemplary embodiment during operation, which is also a cross sectional view taken along line I-I in FIG. 2. FIG. 2 is a plan view showing the mobile crusher 1. FIG. 3 shows a crusher vehicle 2 of the mobile crusher 1 as viewed from the front side. FIG. 4 is a plan view showing a front portion of a feeder vehicle 3 of the mobile crusher 1, and FIG. 5 shows the feeder vehicle 3 as viewed from the front side. FIG. 6 shows a hydraulic circuit used for the mobile crusher 1. In FIGS. 1, 2 and 4, the right side will be referred to as a front side and the left side will be referred to as a rear side according to this exemplary embodiment.

1. Brief Description of Mobile Crusher

As shown in FIGS. 1 and 2, the mobile crusher 1 includes the crusher vehicle 2 and the feeder vehicle 3 connected to each other in the front-rear direction and is disposed in a tunnel A in an underground mine. In the mobile crusher 1, the crusher vehicle 2 and the feeder vehicle 3 are connected at a position where the ore path B is interposed therebetween during crushing operation. In FIG. 1, a high ceiling area provided in the tunnel A is denoted by A'. The high ceiling area A' has a relatively high ceiling corresponding to a working posture of the feeder vehicle 3.

Objects to be crushed such as rocks are inputted into the feeder vehicle 3 by a loader or belt conveyor (not shown) and transferred to the crusher vehicle 2 by the feeder vehicle 3. Then, the objects are crushed by the crusher vehicle 2. The crushed objects are dropped into the ore path B provided in a road surface of the tunnel A and loaded into a lorry or conveyer provided in another tunnel on the lower side of the ore path B.

A crushing device 21 is mounted on the crusher vehicle 2 that crushes objects to be crushed. In the first exemplary embodiment, a jaw crusher is used as the crushing device 21. However, the crushing device according to an aspect of the invention is not limited to a jaw crusher, but may be an impact crusher, cone crusher, roll crusher or the like. The driving source of the crushing device 21 is hydraulic pressure from a first crushing hydraulic pump 23 and a second crushing hydraulic pump that are driven by a later-described electric motor 22. Since the crushed objects crushed by the crushing device 21 are dropped from the crushing device 21 directly into the ore path B provided just under the crushing device 21, a discharging belt conveyor or the like is not provided on the crusher vehicle 2.

Further, a transfer device 31 is mounted on the feeder vehicle 3 to transfer objects to be crushed to the upper portion of the crushing device 21. A metal apron feeder is used as the transfer device 31 in the first exemplary embodiment. The driving source of the transfer device 31 is hydraulic pressure from a transferring hydraulic pump 25 (FIG. 6) driven by the electric motor 22 of the crusher vehicle 2. In other words, the transfer device 31 is driven by hydraulic pressure supplied from the crusher vehicle 2.

In moving in the tunnel A, the crusher vehicle 2 and the feeder vehicle 3 are separated. The crusher vehicle 2 and the feeder vehicle 3 move independently. Each of the crusher vehicle 2 and the feeder vehicle 3 is sufficiently short in the front-rear direction when being separated from each other. Thus, the crusher vehicle 2 and the feeder vehicle 3 can turn at intersections in the narrow tunnel A. Incidentally, the crusher vehicle 2 and the feeder vehicle 3 are traveled by remote control and an operator attends at, for instance, the front side thereof.

For travelling, a pair of right and left crawler carriers 26 are provided on the crusher vehicle 2. The driving source of the carriers 26 is hydraulic pressure from a traveling hydraulic pump 28 driven by a later-described engine 27.

A pair of right and left crawler carriers 32 are provided on the feeder vehicle 3. The driving source of the carriers 32 is hydraulic pressure from a traveling hydraulic pump 34 driven by the engine 33 mounted on the feeder vehicle 3.

In other words, in the mobile crusher 1, the crusher vehicle 2 and the feeder vehicle 3 are operated to crush objects by hydraulic pressure generated by electric drive, and are moved by hydraulic pressure generated by engine drive. Accordingly, the electric drive is not necessary during the movement, so that it is not required for the crusher vehicle 2 and the feeder vehicle 3 to be connected to a power cable while moving. Thus, mobility can be enhanced. Also, a large reel for winding the power cable is not necessary, thus reducing the height of the crusher vehicle 2 and the feeder vehicle 3.

2. Detailed Description of Crusher

The crusher vehicle 2 will be described below in detail. As shown in FIGS. 1 to 3, the crusher vehicle 2 includes a body frame 40 made of metal. The body frame 40 includes a main frame 41 extending in the front-rear direction of the vehicle and traveling frames 42 provided on the right and left sides of the main frame 41. A carrier 26 is attached to each of the traveling frames 42.

The crushing device 21 as described above is mounted on the rear portion of the main frame 41. The height of the crushing device 21 is considerably reduced as compared to that in a typical mobile crusher. A discharge port 21A of the crushing device 21 is provided on the lowermost surface of the body frame 40, which is lower than lower surfaces 42A of the traveling frames 42 included in the body frame 40. The crushing device 21 will be explained later in detail.

As shown in FIG. 6, the electric motor 22, and the first crushing hydraulic pump 23, second crushing hydraulic pump 24, transferring hydraulic pump 25 and fan hydraulic pump 44 that are respectively driven by the electric motor 22 via a PTO (Power Take Off) 43 are provided on the front portion of the main frame 41. In addition, the engine 27, the traveling hydraulic pump 28 driven by the engine 27, a cooling unit 45 for cooling the engine 27, a fuel tank 46, a hydraulic oil tank 47, a cooling unit 48 for cooling hydraulic oil, a power panel 49, batteries 50 and the like are provided on the front portion of the main frame 41. The cooling unit 45 includes a radiator and a cooling fan driven by the engine 27. The cooling unit 48 includes an oil cooler, a cooling fan 59 and a fan driving hydraulic motor 60. These devices are covered with a metal exterior cover 29 and has an appropriate size and shape (for example, the shape conformed to the ceiling of the tunnel A shown in FIG. 3). Incidentally, it is not required that two crushing hydraulic pumps are provided. One crushing hydraulic pump may be provided.

Among the above-described devices, the hydraulic pumps 23, 24, 25, 28 and 44, fuel tank 46 and hydraulic oil tank 47 that are related to hydraulic oil and fuel are provided on the right side of the main frame 41. On the other hand, the electric motor 22, power panel 49 and batteries 50 that are related to electric system of high voltage are provided on the left side of the main frame 41.

However, the electric motor 22, power panel 49, engine 27 and cooling unit 48 for cooling hydraulic oil are taller than other devices and therefore are provided closer to the center in a vehicle-width direction (right-left direction). Accordingly, the devices having small height can be brought together to the right and left sides, thereby realizing the layout conforming to the ceiling of the tunnel A (FIG. 3). Thus, when being moved in the tunnel A, the devices mounted on the crusher vehicle 2 do not easily contact the low ceiling at the right and left sides, thus facilitating traveling operability. Also, the front end of the main frame 41 is shaped such that right and left portions are cut, which also facilitates traveling operability.

A main valve 51, a transfer-device driving valve 52 and a traveling operation valve 53 are provided on the lower portion of the main frame 41 as shown in FIGS. 3 and 6. The main valve 51 switches the flow of hydraulic oil between the first and second crushing hydraulic pumps 23 and 24 and a pair of crushing hydraulic motors 54 for driving the crushing device 21. The transfer-device driving valve 52 switches the flow of hydraulic oil between the transferring hydraulic pump 25 and a pair of transferring hydraulic motors 55 provided on the feeder vehicle 3. The traveling operation valve 53 switches the flow of hydraulic oil between the traveling hydraulic pump 28 and a traveling hydraulic motor 58 that drives final drives 56 and 57 of the carriers 26.

As shown in FIG. 6, the cooling unit 48 includes the fan driving hydraulic motor 60 for driving the cooling fan 59. A reversal solenoid valve 61 is provided between the fan hydraulic pump 44 and the fan driving hydraulic motor 60 to switch the flow of hydraulic oil therebetween.

A control panel 62 for controlling the crushing device 21 and a power receiver 63 (see FIG. 1) are provided on the left lateral side of the main frame 41. The power receiver 63 is connected with a power cable from an electrical supply network spreading over the tunnels A. The electric power supplied to the power receiver 63 via the power cable is supplied to the electric devices such as the electric motor 22 and batteries 50 via a transformer or a voltage stabilizer provided on the power panel 49.

A hydraulic supply 64 (FIG. 6) is provided on the rear portion of the main frame 41. A male member or female member of a quick-coupler 64B attached to a hydraulic pipe 64A extended from the transfer-device driving valve 52 is fixed to the hydraulic supply 64. A male member or female member of a quick-coupler 64D attached to a hydraulic pipe 64C extended from the transferring hydraulic motor 55 is connected to the male member or female member of the quick-coupler 64B. Hydraulic oil flows between the crusher vehicle 2 and the feeder vehicle 3 by the connection between the quick-couplers 64B and 64D.

A pair of right and left crusher-side connecting portions 65 to which the feeder vehicle 3 is connected are provided on the posterior end of the main frame 41. The crusher-side connecting portions 65 will be explained later in detail.

3. Detailed Description of Crushing Device

The crushing device 21 mounted on the crusher vehicle 2 will be described in detail. The jaw crusher serving as the crushing device 21 includes a fixed jaw 11 and a swing jaw 12 that is swingable. While the upper end of the swing jaw 12 is suspended from an eccentric shaft 14 that eccentrically rotates, the lower end of the swing jaw 12 is supported by a typical reaction-force-receiving link mechanism (not shown) that receives reaction force during crushing operation. Rocks such as ores that are inputted between the fixed jaw 11 and the swing jaw 12 are squeezed therebetween by swing of the swing jaw 12 to be crushed.

The eccentric shaft 14 is supported by right and left side frames 13 each having a plate-shape. At proper portions of the side frames 13 in the up-down direction, fixed portions 15 horizontally protruding outwardly are sequentially provided in the front-rear direction. The crushing device 21 is disposed such that the fixed portions 15 are positioned on the upper side of the main frame 41, and is fixed to the main frame 41 by an appropriate fixing unit such as a bolt at the fixed portions 15. Consequently, the discharge port 21A is disposed lower than the lower surfaces 42A of the traveling frames 42 that are disposed at the lowermost side of the body frame 40, so that the whole crushing device 21 sinks down relative to the body frame 40.

A flywheel 16 is attached to both sides of the eccentric shaft 14 (only the left side is shown in FIG. 1). The flywheel 16 has a much smaller diameter than that of a typical jaw crusher. The upper end of the swing jaw 12 is located at a higher position than the upper portion of the flywheel 16. The flywheel 16 is also used as a pulley and is driven by the crushing hydraulic motor 54 via a plurality of belts wound around an outer circumference.

In other words, the swing jaw 12 is driven by a large torque under hydraulic pressure. Accordingly, inertial force for effectively sustaining swing movement required for crushing operation can be reduced as compared to a typical arrangement where the swing jaw is driven by an electric motor, thus considerably reducing the diameter of the flywheel 16. Typically, the diameter of a flywheel is extremely large and an upwardly protruding amount of the flywheel is increased. In this exemplary embodiment, however, the upwardly protruding amount of the flywheel 16 can be reduced and thus the height of the crusher vehicle 2 can be reliably reduced.

Further, in this exemplary embodiment, the crushing device 21 is disposed upright such that a tooth flank of the fixed jaw 11 is substantially orthogonal (89.8 degrees in the exemplary embodiment) to a horizontal surface. In other words, the crushing device 21 is inclined to the front side as a whole, so that the fixed jaw 11, which is typically disposed at a low position, is slightly lifted up while the swing jaw 12, which is typically disposed at a high position, is inclined forwardly. Consequently, the upper end of the swing jaw 12 opposite to the fixed jaw 11, i.e., the flywheel 16, is shifted downwardly, thus reducing the height of the crusher vehicle 2.

In the crushing device 21 as described above, guard members 17 are disposed upright on the side frames 13. The front end of the transfer device 31 of the feeder vehicle 3 intrudes between the right and left guard members 17. Since rocks inputted from the transfer device 31 are guarded by the guard members 17, the rocks are not dropped to the left or right of an input port 21B upwardly opened.

A slope 19 inclined downwardly toward the front side of the fixed jaw 11 and a slope 20 inclined downwardly toward the rear side of the fixed jaw 11 are provided on the upper end of a rear frame 18 to which the fixed jaw 11 is fixed. Small rocks and the like dropped onto the slope 19 on the front side are reliably inputted into the crushing device 21, and then dropped into the ore path B directly from the discharge port 21A without being crushed. Also, small rocks and the like dropped onto the slope 20 on the rear side are conveyed through the rear side of the rear frame 18 to be dropped into the ore path B. At this time, rocks are reliably guided into the ore path B by a chute 100 provided on the feeder vehicle 3.

4. Detailed Description of Feeder

The feeder vehicle 3 will be described below in detail. As shown in FIG. 1, the feeder vehicle 3 also includes a body frame 70 made of metal. The body frame 70 includes a main frame 71 extended in the front-rear direction of the vehicle and a pair of right and left traveling frames 72 to which the carriers 32 are attached.

Right and left support brackets 73 protruding upwardly are provided on the rear side of the main frame 71. A relatively rear portion of the apron feeder (the transfer device 31) is rotatably pivoted on the support brackets 73. In other words, the transfer device 31 is rotatably pivoted on the body frame 70 by a horizontal rotary shaft provided in a direction orthogonal to the front-rear direction at a proper portion of the transfer device 31 in the front-rear direction.

As shown in FIG. 4, cylinder supports 74 are provided on box-shaped portions provided on a relatively front side of the main frame 71. Rods of lift cylinders 75 for raising and lowering the transfer device 31 are rotatably supported by the cylinder supports 74. Cylinder housings of the lift cylinders 75 are rotatably attached to a relatively front lower surface of the transfer device 31. Accordingly, the transfer device 31 and the body frame 70 are connected via the support brackets 73 and the lift cylinders 75. FIGS. 1, 2 and 5 show a posture of the transfer device 31 during crushing operation. In this posture, the lift cylinders 75 is extended and the transfer device 31 is raised.

On the front side of the main frame 71, the engine 33, the traveling hydraulic pump 34 driven by the engine 33 and a lift hydraulic pump 76 are provided in the center in the vehicle-width direction (right-left direction). As shown in FIG. 6, a traveling operation valve 77 and a lift valve 78 are provided in the vicinity of the hydraulic pumps 34 and 76. The traveling operation valve 77 switches the flow of hydraulic oil between the traveling hydraulic pump 34 and a traveling hydraulic motor 81 that drives final drives 79 and 80 of the carries 32. The lift valve 78 switches the flow of hydraulic oil between the lift hydraulic pump 76 and the lift cylinders 75.

The hydraulic oil supplied to the lift cylinders 75 and the traveling hydraulic motor 81 are not supplied from the crusher vehicle 2, but are supplied from a hydraulic oil tank 85 (FIGS. 4 and 5) on a plate 82 provided on the front left lateral surface of the main frame 71. A control panel 86 is mounted also on the plate 82. The hydraulic oil tank 85 and the control panel 85 are disposed on the upper side of the right carrier 32.

On the upper side of the right carrier 32, another plate 82 is integrally provided on the front right lateral surface of the main frame 71. A fuel tank 83 and a battery 84 are mounted on this plate 82.

The engine 33, pumps 34 and 76, valves 77 and 78, tanks 83 and 85, battery 84 and control panel 86 are covered with an exterior cover 87. For avoiding the interference when the transfer device 31 is laid down, the engine 33 and valves 77 and 78 are disposed at the center of the main frame 71 and the tanks 83 and 85, battery 84 and control panel 86 are separately placed on the right and left sides of the main frame 71. In other words, when all devices are disposed at the center, it is difficult to avoid the interference with the transfer device 31 and therefore the transfer device 31 may not be laid down. Further, since the devices are hidden under the transfer device 31, operability and maintenance capability are extremely deteriorated. However, which ones of the tanks 83 and 85, battery 84 and control panel 86 are to be placed on the left or the right may be suitably determined. As long as at least two of the above devices are placed separately on the left and right, the other devices are not necessarily placed separately on the left and right.

Figure 7:
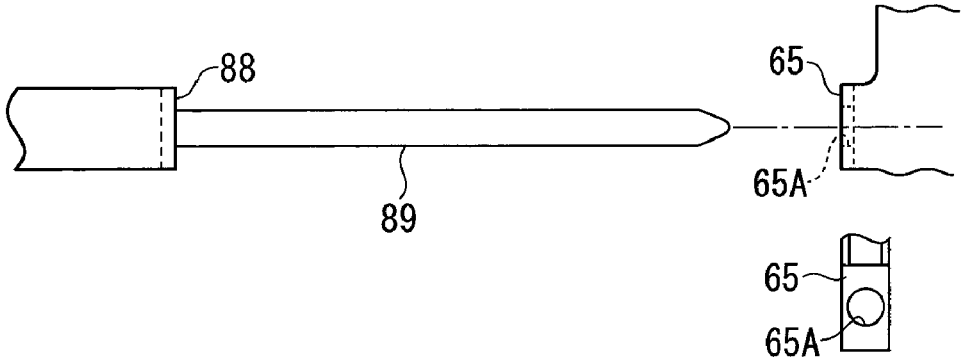
FIG. 7 shows a connecting portion of the crusher vehicle and the feeder vehicle.

In FIG. 4, the right and left forefront ends of the main frame 71 provide feeder-side connecting portions 88 that correspond to the crusher-side connecting portions 65 of the crusher vehicle 2. A guide pin 89 that horizontally protrudes forward is fixed to each of the feeder-side connecting portions 88. As shown in FIG. 7, the guide pin 89 is inserted into a guide hole 65A provided on each of the crusher-side connecting portions 65. While the guide pins 89 are inserted into the guide holes 65A, the connecting portions 65 and 88 are contacted with each other. With this operation, positioning of the crusher vehicle 2 and the feeder vehicle 3 is performed. The guide pins 89 and the guide holes 65A provide a positioning unit of the invention.

The guide pin 89 needs to protrude further forwardly than the front end of a later-described hopper 96 provided on the transfer device 31, i.e., the portion located between the guard members 17 of the crushing device 21. However, when the guard members 17 are retractable, it is not required that the guide pin 89 protrudes forwardly further than the front end of the hopper 96 as shown in the figure, and thus the guide pin 89 can be shortened.

Figure 8:
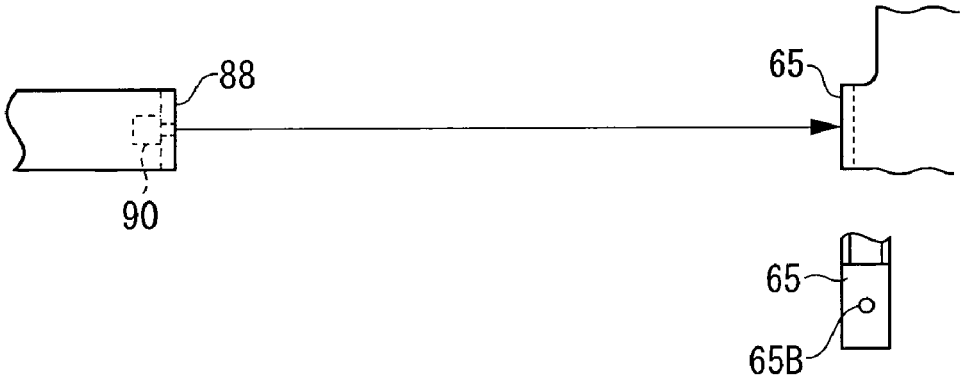
FIG. 8 shows a modification of the connecting portion of the crusher vehicle and the feeder vehicle.

Incidentally, the positioning unit for the crusher vehicle 2 and the feeder vehicle 3 is not limited to the guide holes 65A and the guide pins 89 provided on the connecting portions 65 and 88. In FIG. 8, as a modification of the positioning unit, a light-emitting device 90 for emitting visible light such as laser beam is provided on the feeder-side connecting portion 88, and a target portion 65B defining a light-receiving area for receiving light from the light-emitting device 90 is provided on the crusher-side connecting portion 65. Such a positioning unit is provided at the right and left sides of the crusher vehicle 2 and feeder vehicle 3. Accordingly, when the crusher vehicle 2 and the feeder vehicle 3 are moved closer to each other while outgoing light beam from the light-emitting device 90 is maintained to be received within the target portion 65B, the connecting portions 65 and 88 can be contacted with each other at an appropriate position and thus are accurately positioned.

Alternatively, the guide pin 89 and the light-emitting device 90 may be provided on the crusher-side connecting portion 65, and the guide hole 65A and the target portion 65B may be provided on the feeder-side connecting portion 88.

5. Detailed Description of Transfer Device

The transfer device 31 mounted on the feeder vehicle 3 will be described below in detail. In the transfer device 31, a conveyer 92 including a plurality of metal plates 91 for bridging the right and left sides is driven by right and left drive bodies 93. A sprocket (not shown) driven by the transferring hydraulic motor 55 is provided on the front end of each drive body 93, and an idler 95 is provided on the rear end. The conveyor 92 is wound around the sprocket and the idler 95. In the posture during the crushing operation, the base end of the inclined transfer device 31 is so lowered that its lower end reaches a position between the right and left carriers 32. Accordingly, even in a workplace having a low ceiling such as the tunnel A, rocks can be loaded by a loader.

The hopper 96 opened upwardly is provided on the upper portion of the transfer device 31 to continuously extend in the front-rear direction. The upper edge of the hopper 96 is inclined such that the hopper 96 is gradually shallow from the middle to the front side in the front-rear direction. Eaves 97 are provided along the inclined upper edge of the hopper 96 according to the first exemplary embodiment. The eaves 97 are inclined downwardly as they extend outwardly to have a half-wing shape (a shape when a bird spreads his wings half). The eaves 97 increases their width as they extend forward to have a triangle-shape. However, the width of the whole hopper 96 including the eaves 97 is substantially the same in the front-rear direction. Though the lower edges of the eaves 97 extend slightly further than the carriers 32, the extension of the lower edges is arranged not to rub the ceiling or side wall during movement in the tunnels A.

The eaves 97 extend over the fuel tank 83, battery 84, hydraulic oil tank 85 and control panel 86 that are located at the lower position so as to prevent rocks thrown out from the hopper 96 from falling onto these devices.

Also, guard members 98 extending downwardly are provided on the right and left sides at the front end of the hopper 96. The front end of the transfer device 31 is positioned at the upper side of the crushing device 21. At this time, the guard members 98 are positioned close to the inner sides of the right and left guard members 17 provided on the crushing device 21 and interposed between the right and left guard members 17. Rocks conveyed by the transfer device 31 are guarded by the guard members 17 and 98 and reliably inputted into the input port 21B of the crushing device 21.

A rotary brushing device 99 for removing small rocks adhering to the conveyor 92 on the lower side is provided on the lower portion of the transfer device 31. Further, a chute 100 is provided on the rear side of the brushing device 99. The chute 100 guides to the ore path B the rocks removed by the brushing device 99.

Figure 9:
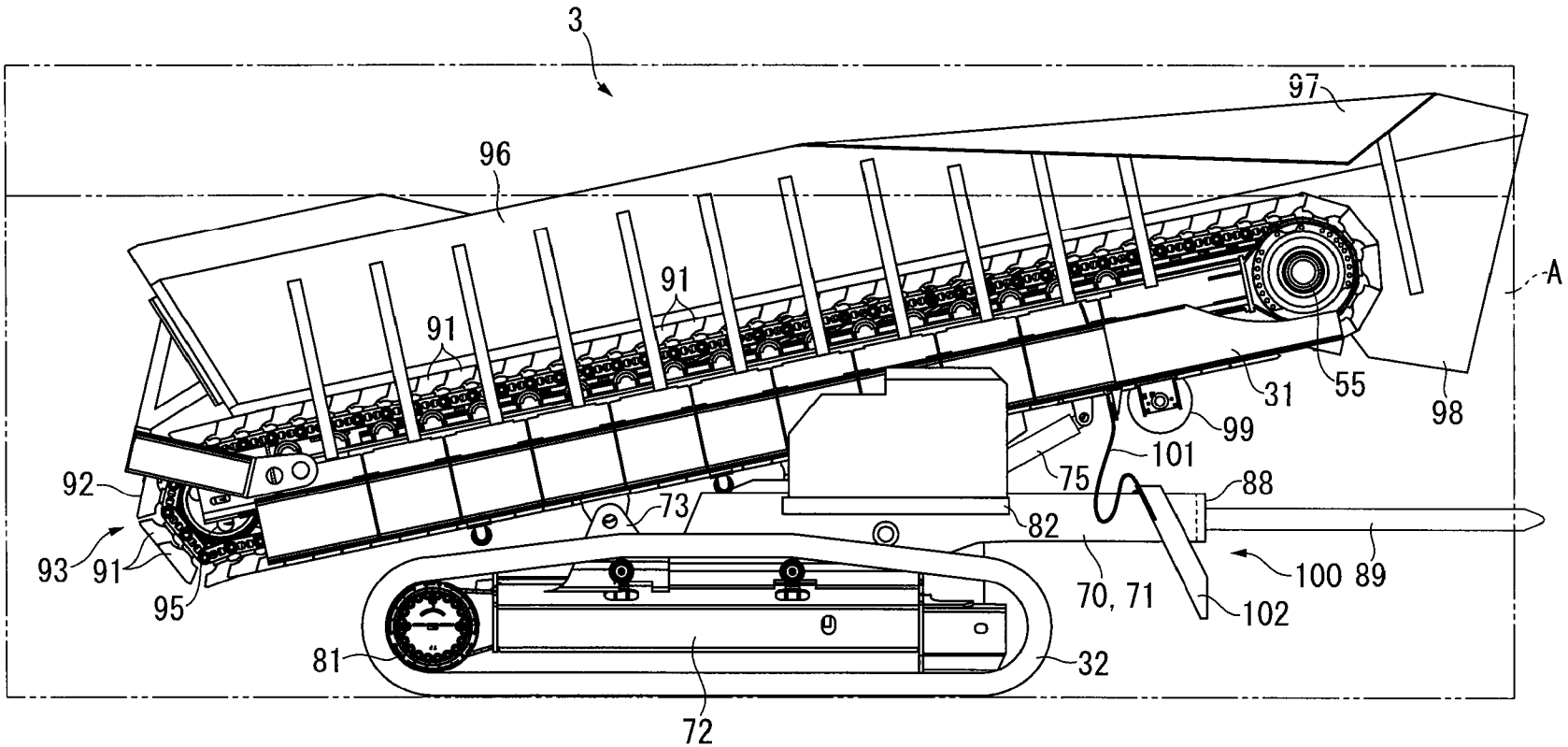
FIG. 9 is a side view showing a posture of the feeder vehicle during movement.

The upper portion of the chute 100 is provided by a flexible member 101 such as a rubber sheet, and the lower portion of the chute 100 is provided by a plate member 102 made of metal. The plate member 102 is disposed in the main frame 71 and is fixed to the main frame 71 on the right and left sides. When the transfer device 31 is laid down, the flexible member 101 is bended so that the chute 100 is accommodated under the lower side of the conveyor 92 (FIG. 9). Incidentally, the chute 100 may be alternatively provided on the crusher vehicle 2.

Figure 10:
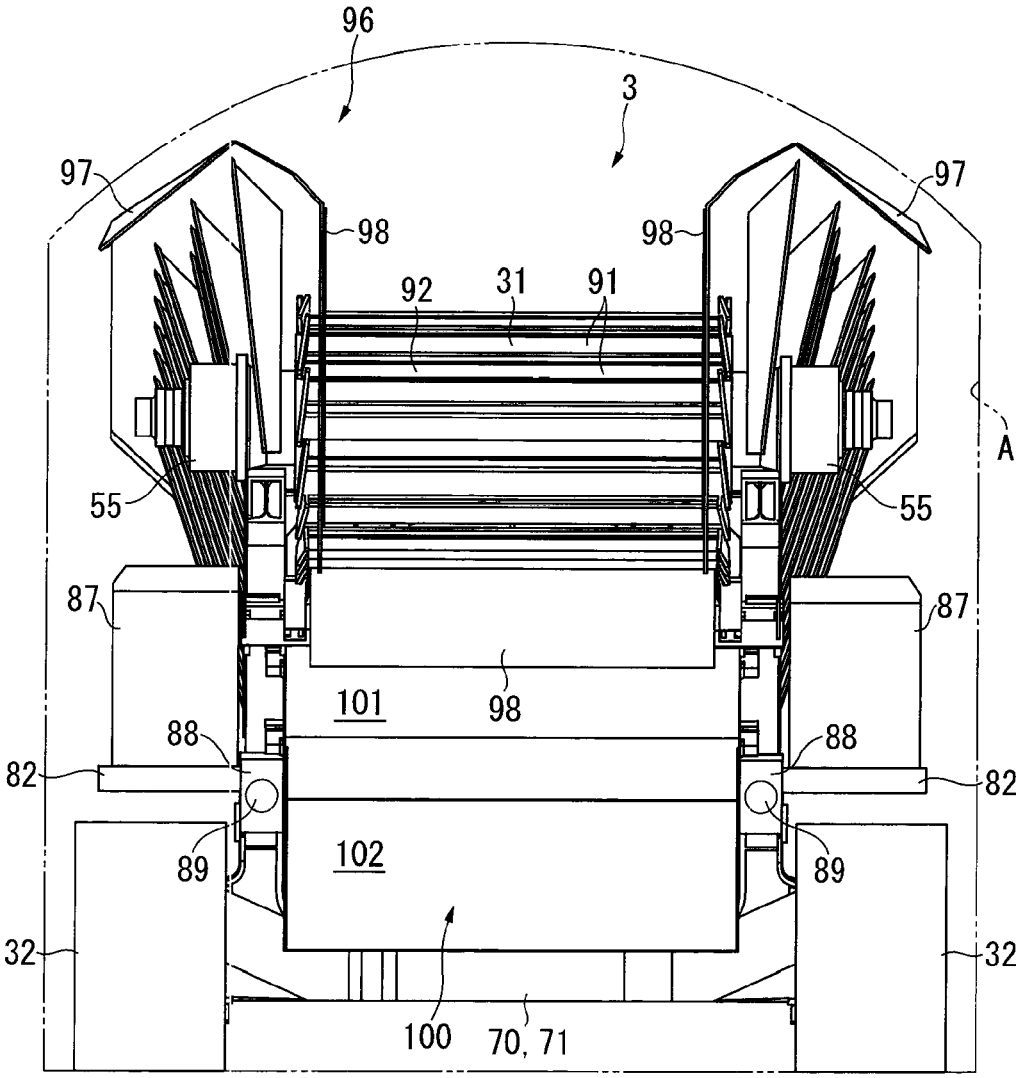
FIG. 10 shows the posture of the feeder vehicle during movement as viewed from the front side.

FIGS. 9 and 10 show the feeder vehicle 3 in the traveling posture in which the lift cylinder 75 is retracted and the transfer device 31 is laid down. In the traveling posture, the upper edge of the hopper 96 provided on the transfer device 31 is lower than the ceiling of the tunnel A. As shown in FIG. 10, the eaves 97 are outwardly inclined substantially along the ceiling and thus the eaves 97 do not rub against the ceiling.

6. Movement and Connection during Crushing Operation

In the mobile crusher 1 as described above, the crusher vehicle 2 and the feeder vehicle 3 move separately toward a workplace for crushing operation. In the workplace for crushing operation, the crusher vehicle 2 is initially positioned relative to the ore path B. The crusher vehicle 2 is positioned such that the discharge port 21A of the crushing device 21 mounted on the crusher vehicle 2 is positioned directly above the center of the ore path B.

Subsequently, the feeder vehicle 3 is approached to the rear portion of the crusher vehicle 2, and the transfer device 31 is lifted up at a position where the feeder vehicle 3 is spaced apart from the crusher vehicle 2 by a predetermined interval. Then, the guide pins 89 of the feeder-side connecting portions 88 of the feeder vehicle 3 are inserted into the guide holes 65A of the crusher-side connecting portions 65 and the feeder vehicle 3 is moved closer to the crusher vehicle 2, so that the feeder-side connecting portions 88 are brought into abutment with the crusher-side connecting portions 65 to position the feeder vehicle 3 relative to the crusher vehicle 2.

Here, the guard members 17 provided on the crushing device 21 may be retractable and folded downwardly during movement. During crushing operation, the guard members 17 may be raised after the guard members 98 provided on the transfer device 31 are positioned on the upper side of the crushing device 21. Further, a hydraulic outrigger may be provided on the rear portion of the transfer device 31. The outrigger may be seated on a road during the crushing operation so that vertical load applied when rocks are inputted into the hopper 96 is received by the outrigger. Alternatively, a retractable leg device may be provided instead of the outrigger. At this time, only when the transfer device 31 is raised for crushing operation, the leg device is seated on the road so that a load is transmitted to the road.

Figure 11:
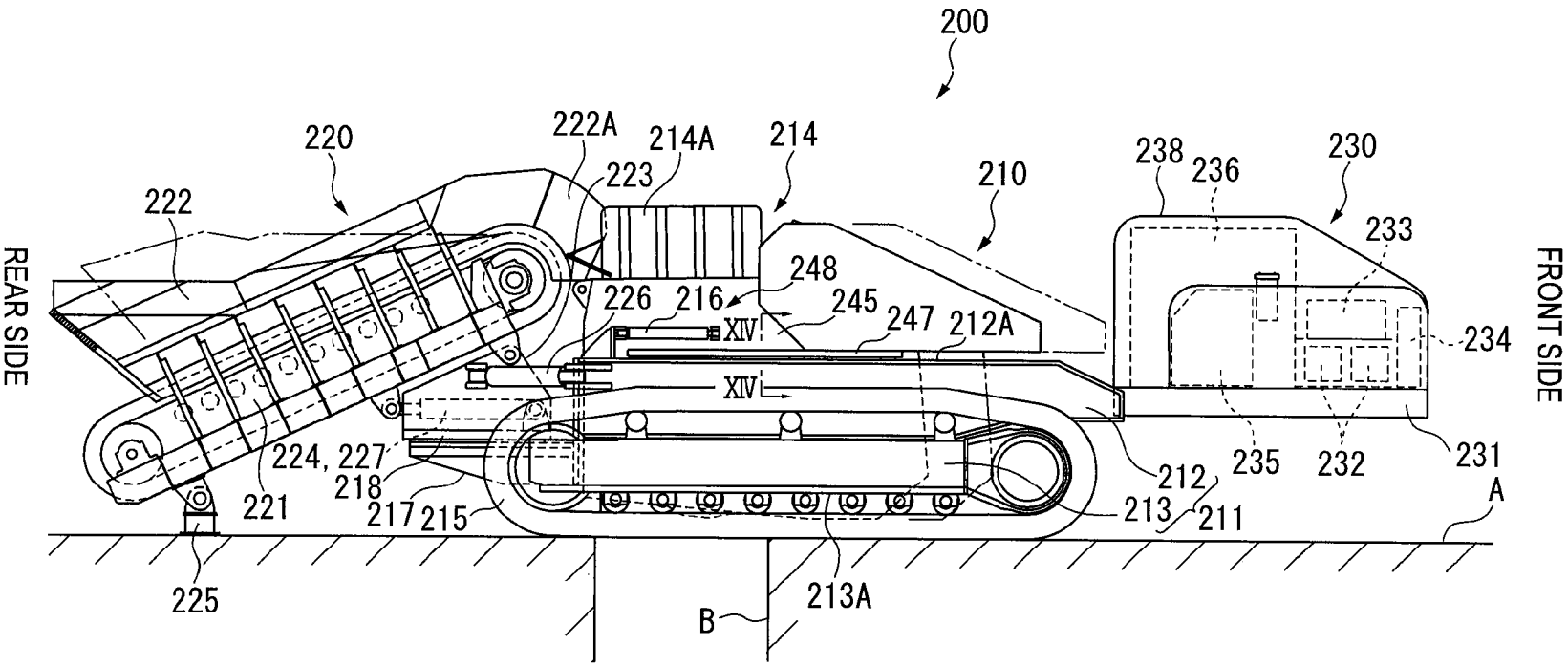
FIG. 11 is a side view of a mobile crusher according to a second exemplary embodiment of the invention.
Figure 12:
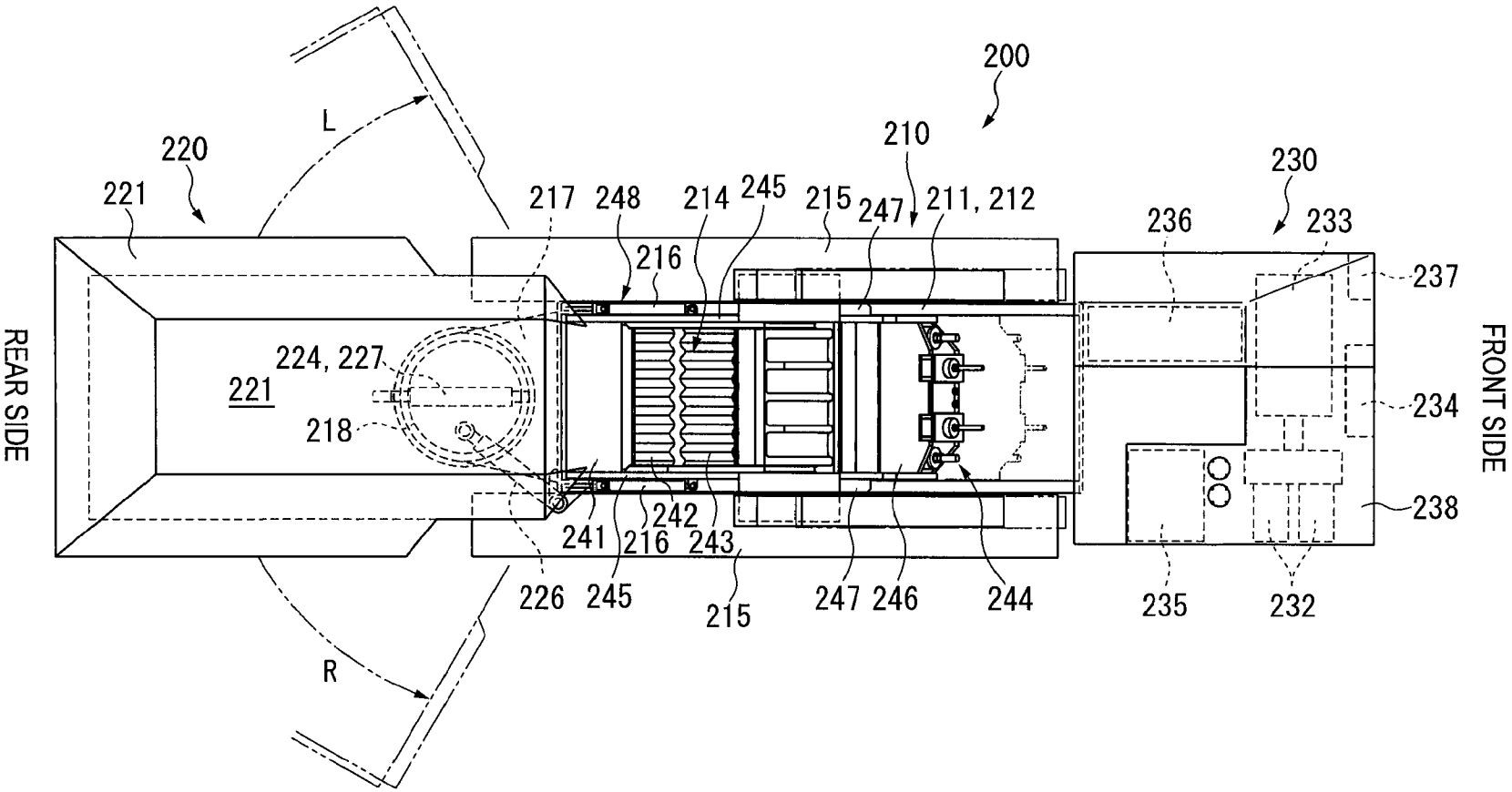
FIG. 12 is a plan view according to the second exemplary embodiment.
Figure 13:
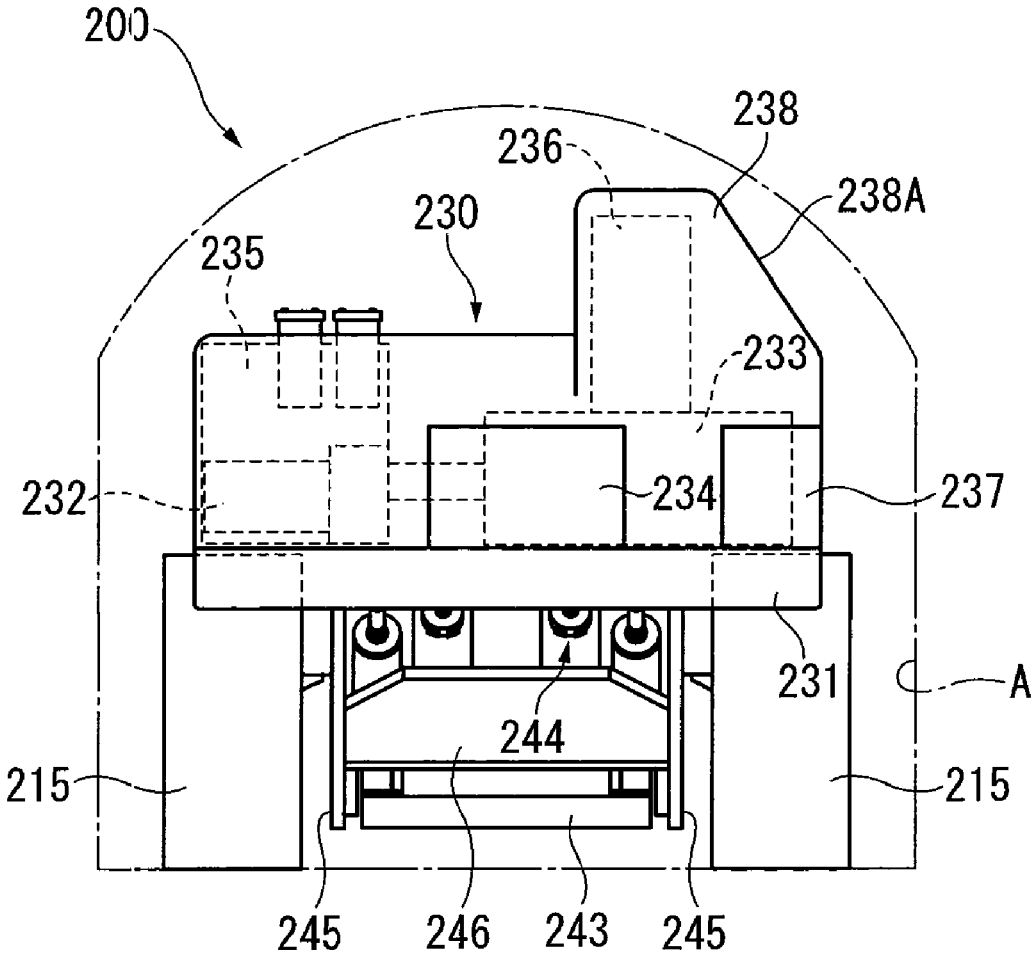
FIG. 13 is a front view according to the second exemplary embodiment.
Figure 14:
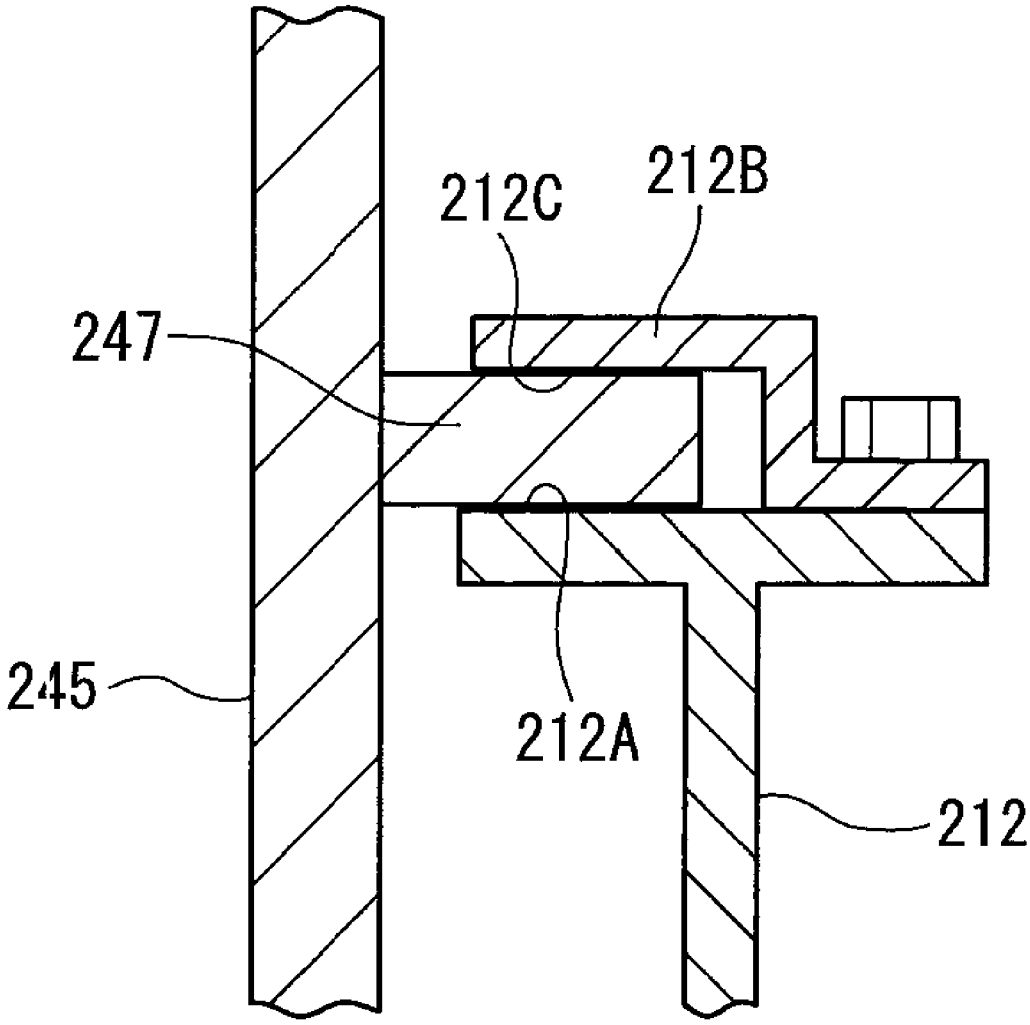
FIG. 14 is a cross-sectional view of a guide, which is taken along line XIV-XIV in FIG. 11, according to the second exemplary embodiment.
Figure 15:
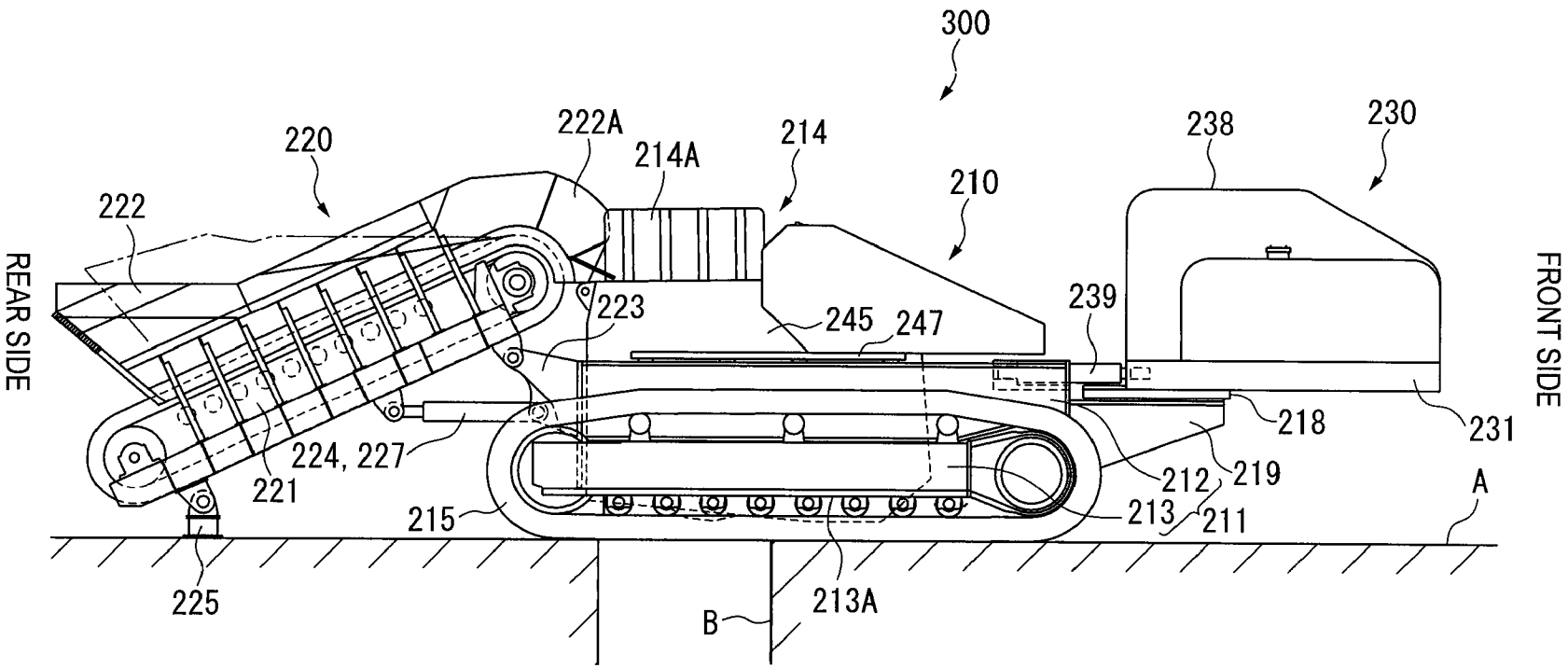
FIG. 15 is a side view of a mobile crusher according to a third exemplary embodiment of the invention.
Figure 16:
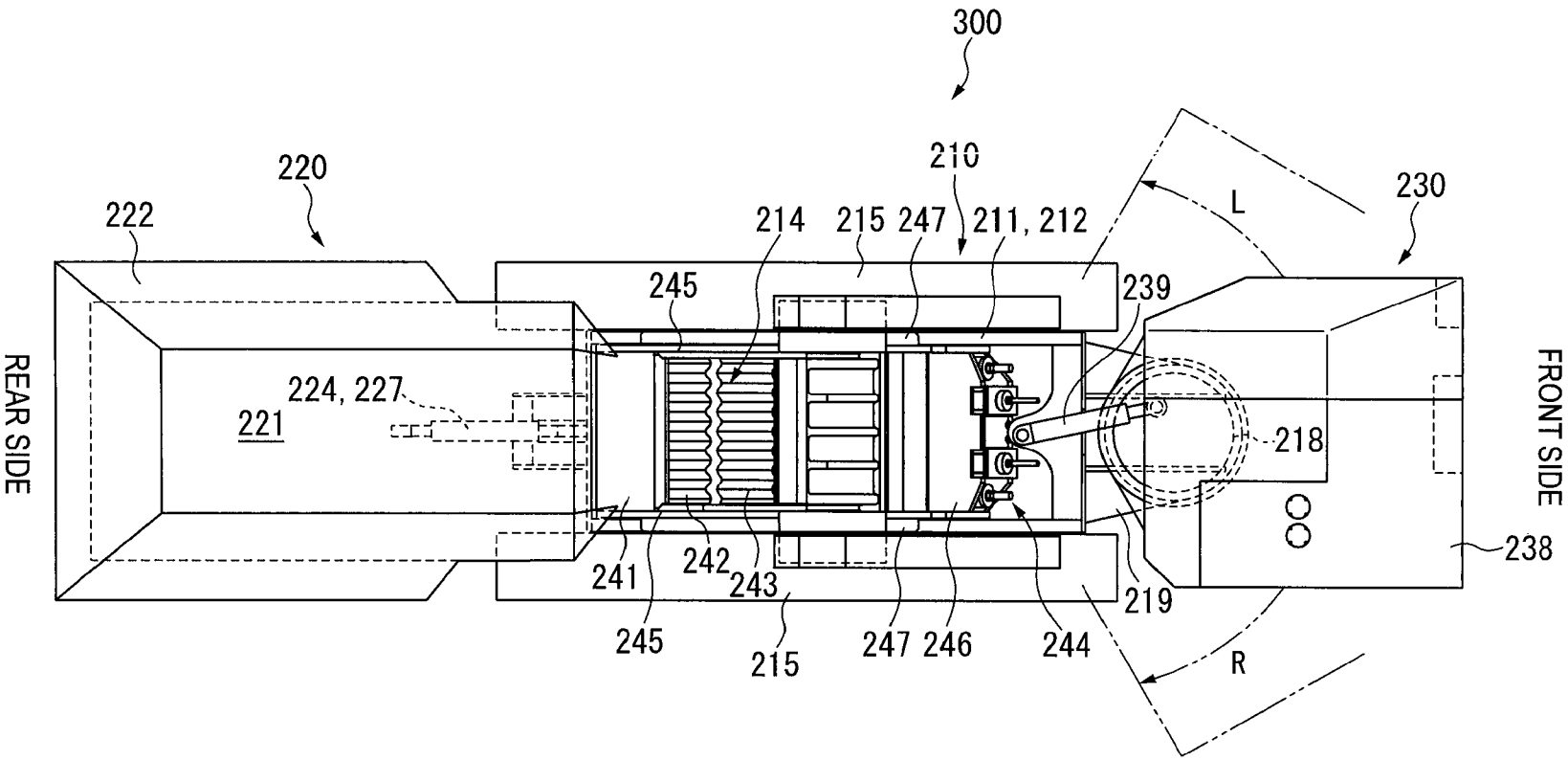
FIG. 16 is a plan view according to the third exemplary embodiment.
Figure 17:
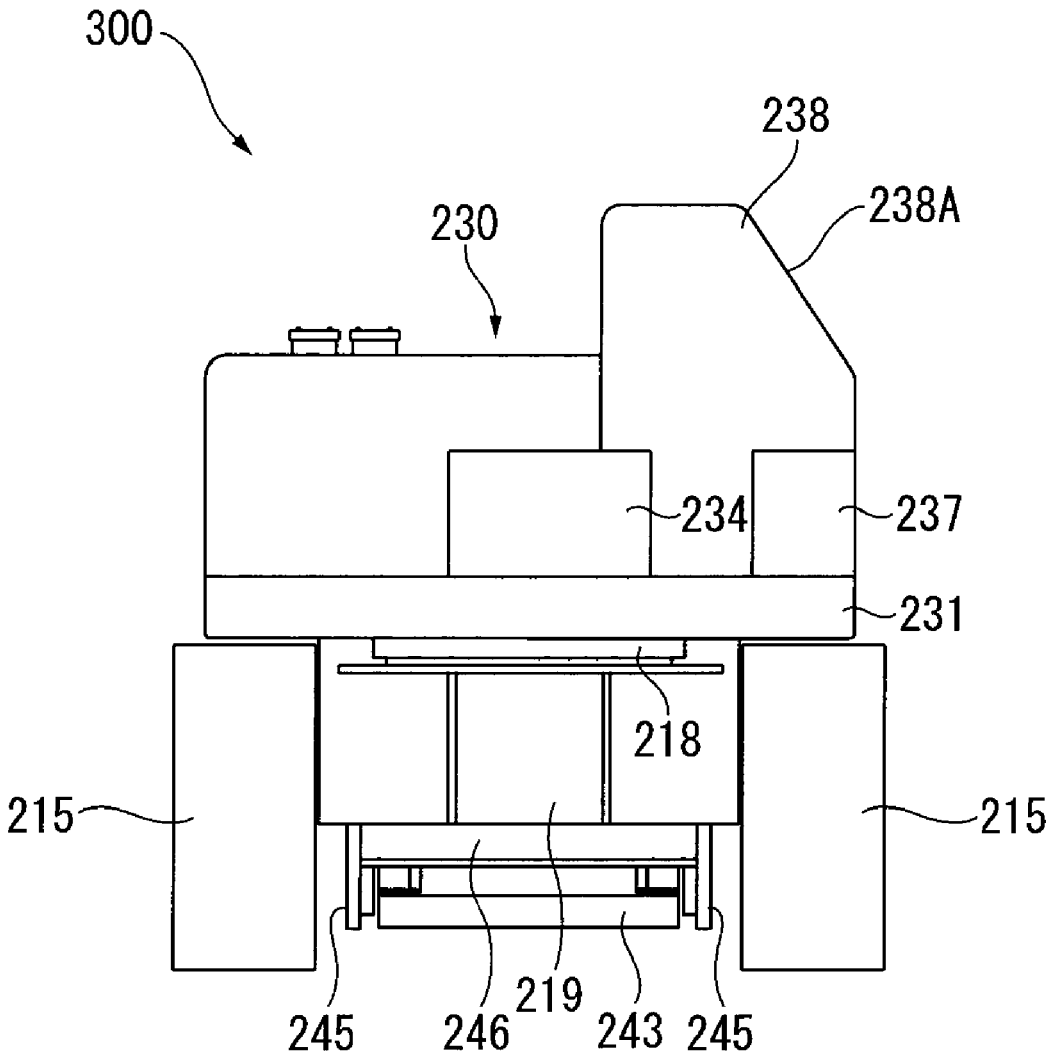
FIG. 17 is a front view according to the third exemplary embodiment.
Figure 18:
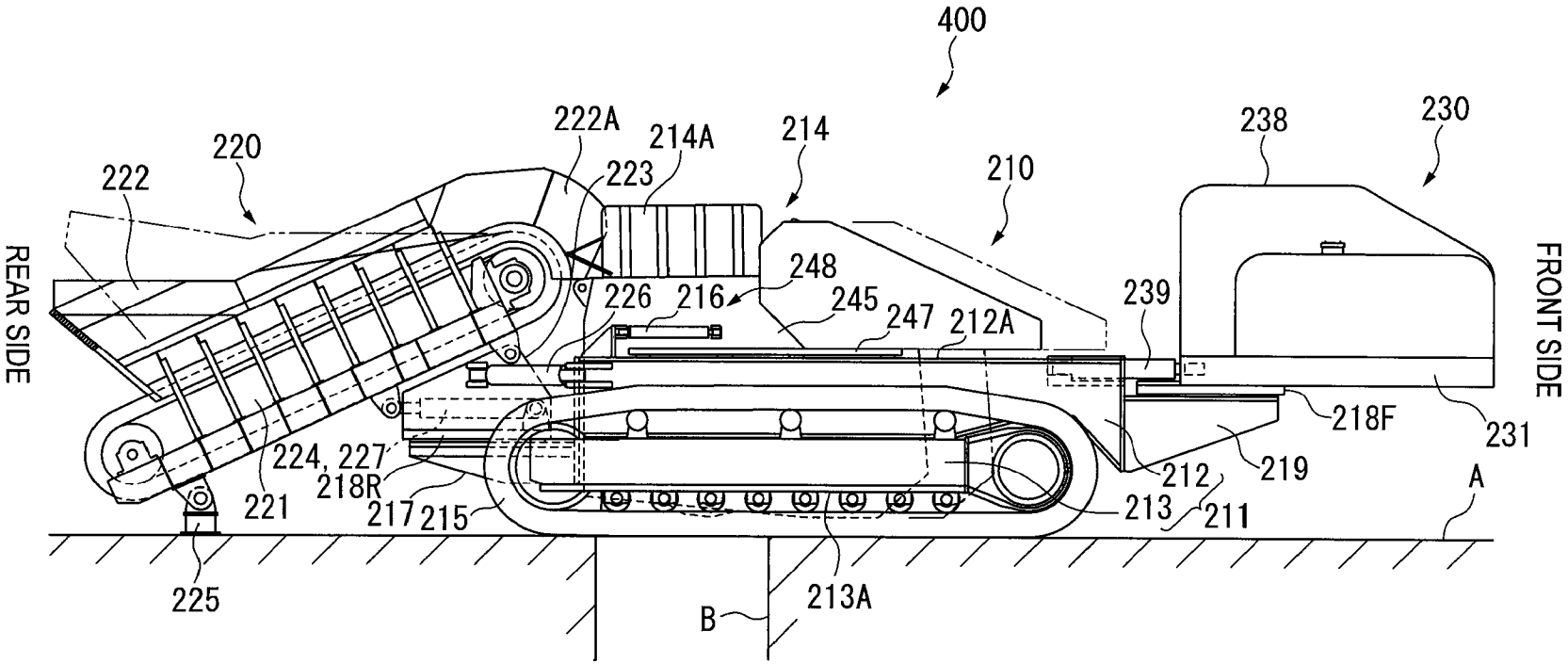
FIG. 18 is a side view of a mobile crusher according to a fourth exemplary embodiment of the invention.
Figure 19:
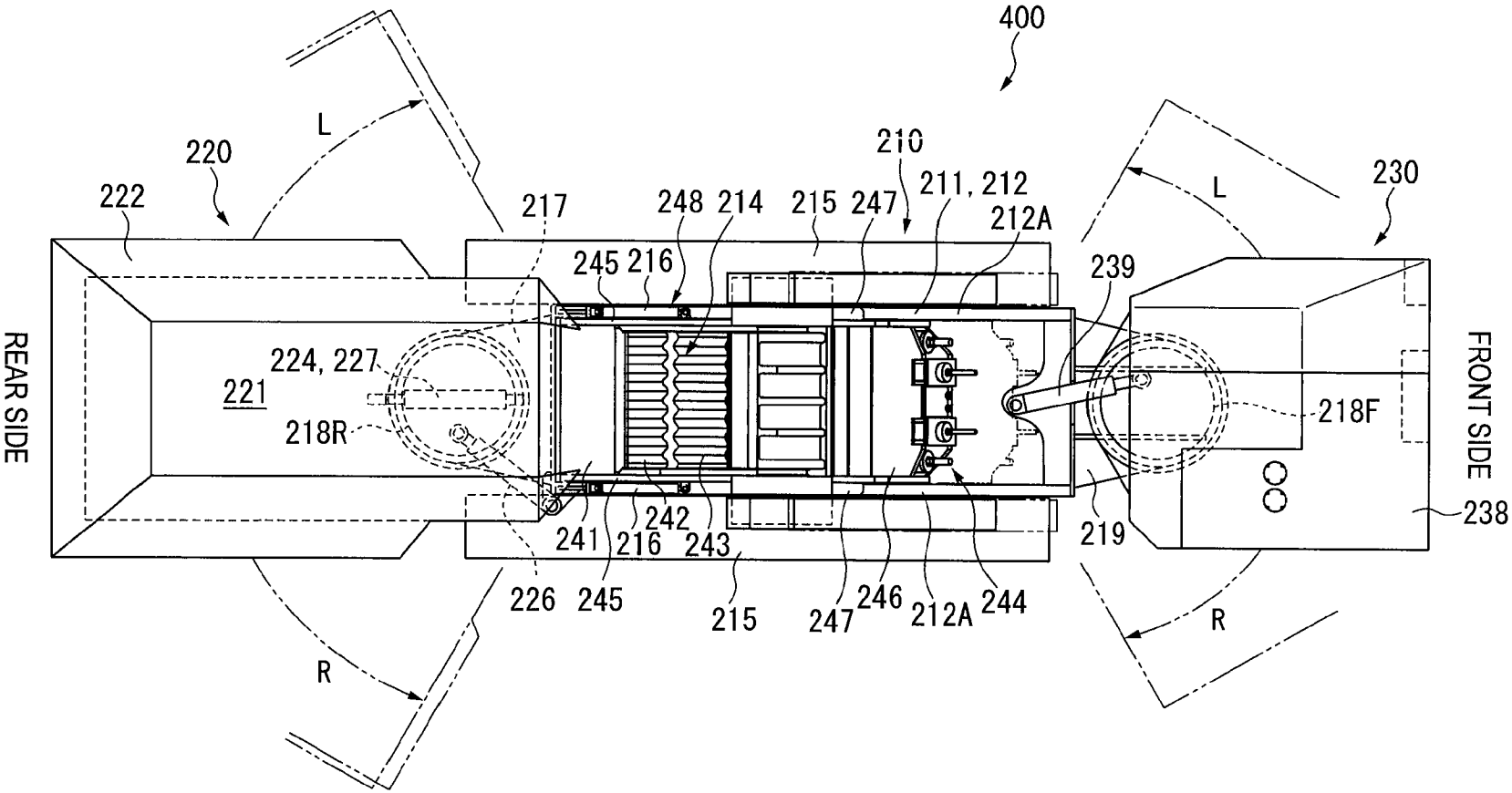
FIG. 19 is a plan view according to the fourth exemplary embodiment.
Figure 20:
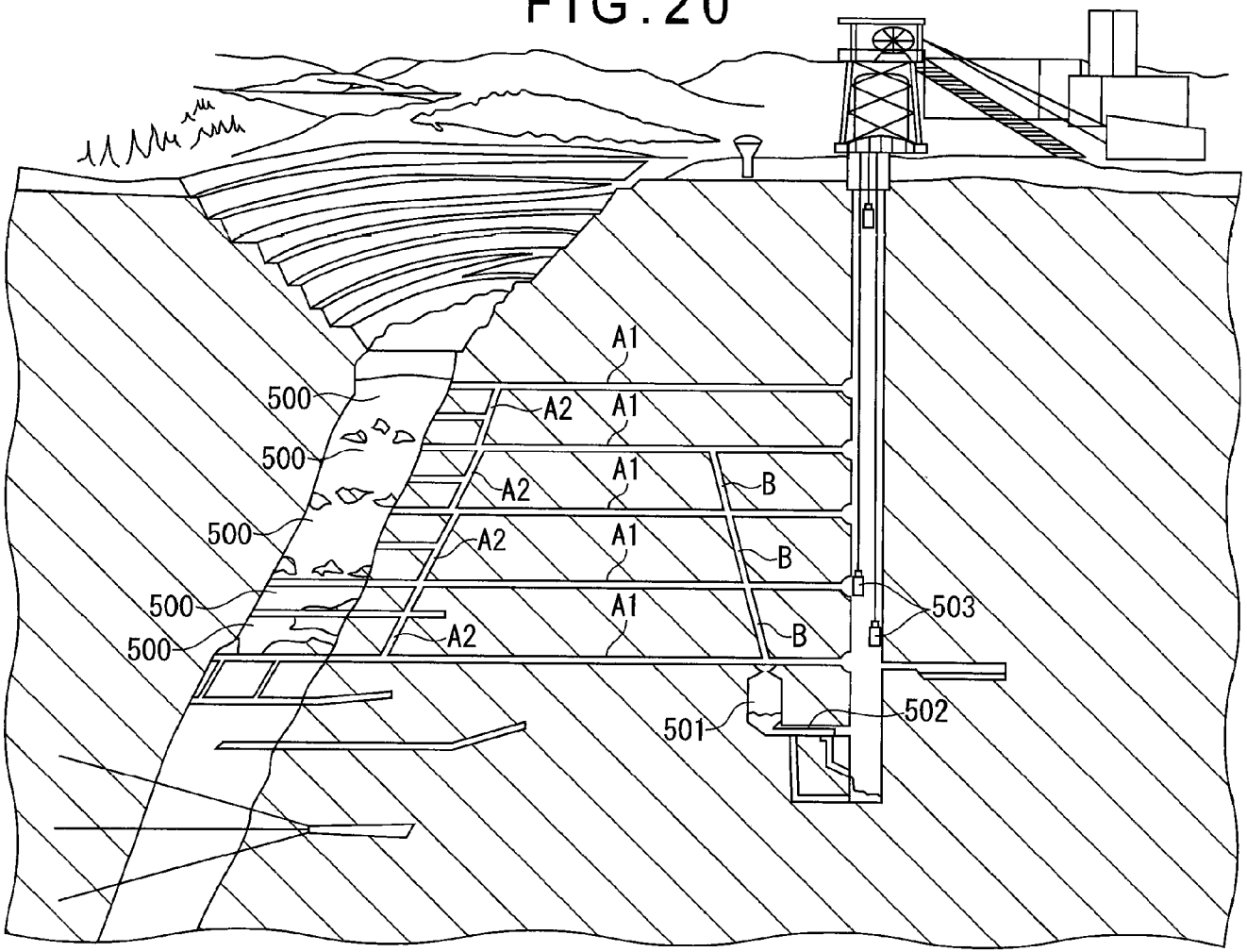
FIG. 20 is a longitudinal sectional view of an underground mine for explaining a related art of the invention.
Figure 21:
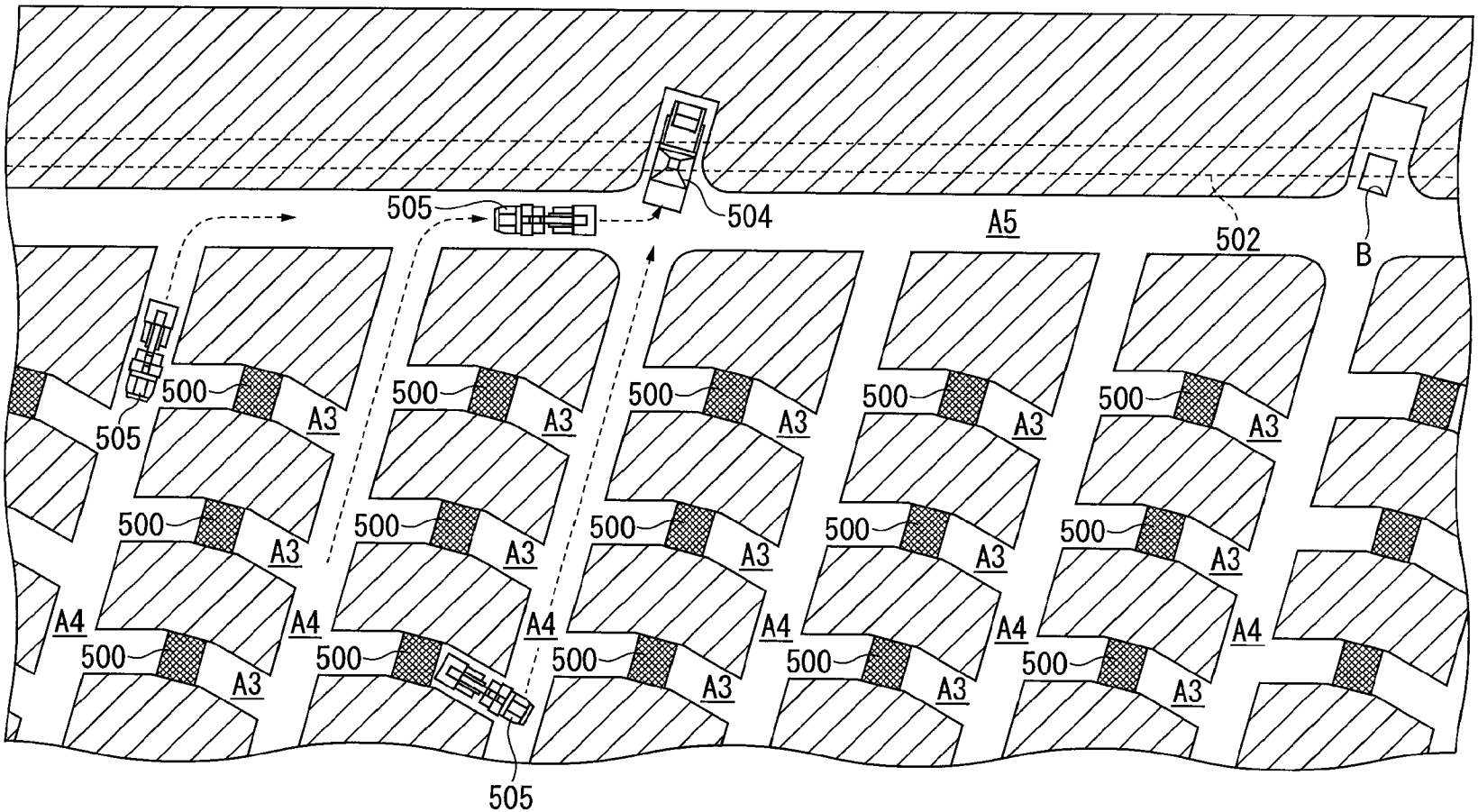
FIG. 21 is a plan sectional view of another underground mine for explaining a related art of the invention.
Figure 22:
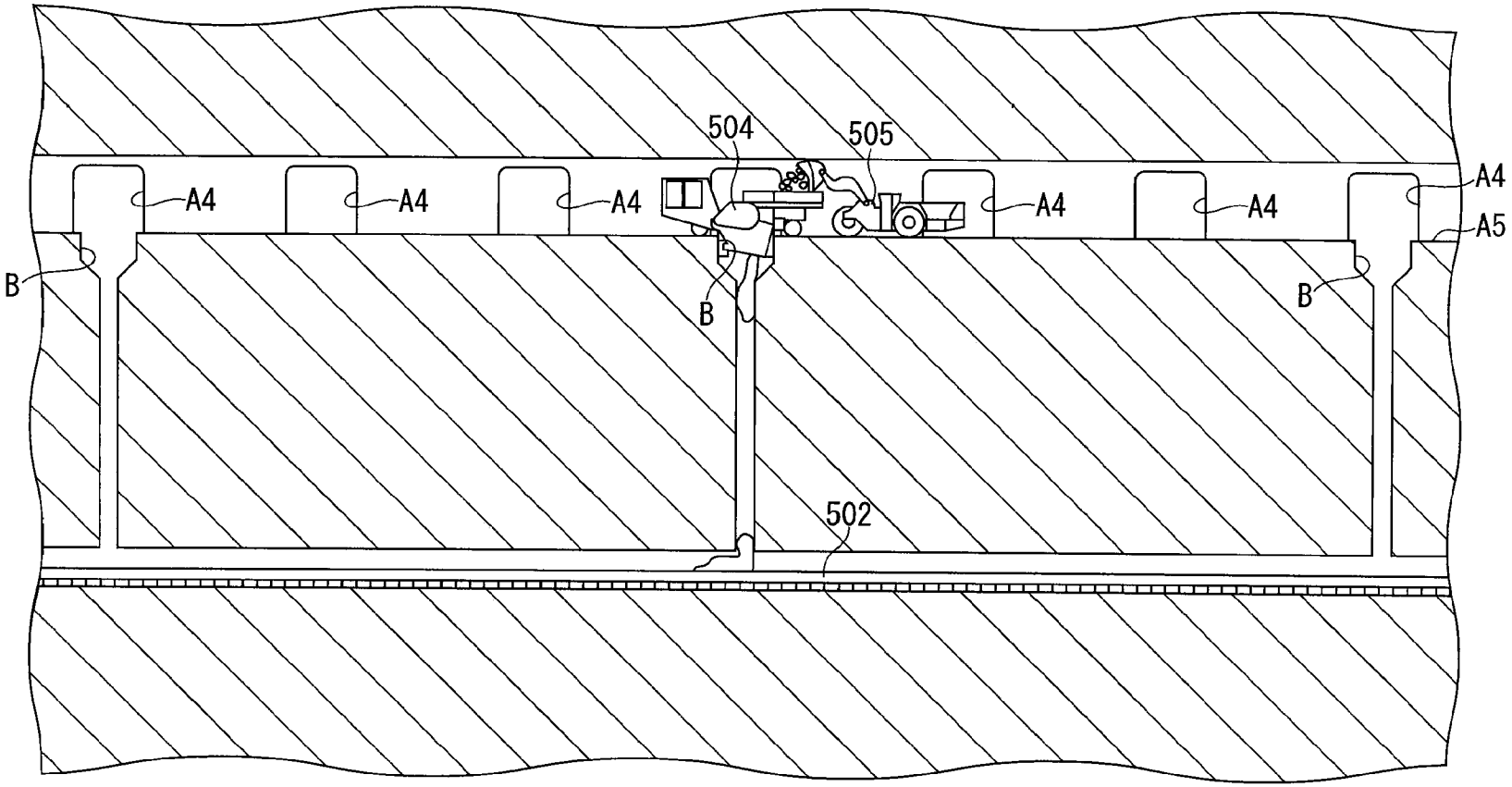
FIG. 22 is a longitudinal sectional view of the another underground mine.

Second to fourth exemplary embodiments of the invention will be described below with reference to the attached drawings. FIGS. 11 to 13 are a side view, a plan view and a front view of a mobile crusher 200 according to the second exemplary embodiment. FIG. 14 is a cross-sectional view of a guide according to the second exemplary embodiment. FIGS. 15 to 17 are a side view, a plan view and a front view of a mobile crusher 300 according to the third exemplary embodiment. FIGS. 18 and 19 are a side view and a plan view of a mobile crusher 400 according to the fourth exemplary embodiment. In the above-described side views and plan views, the right side will be referred to as a front side of the mobile crusher 200, 300 or 400 and the left side will be referred to as a rear side of the mobile crusher 200, 300 or 400.

Second Exemplary Embodiment

As shown in FIGS. 11 and 12, the mobile crusher 200 of the second exemplary embodiment is installed in the tunnel A in an underground mine or the like to crush objects to be crushed such as rocks and input the crushed objects into the ore path B provided on a road. More specifically, the mobile crusher 200 includes: a vehicle body 210 provided over the ore path B; a feeder unit 220 provided on the rear side of the vehicle body 210; and a power unit 230 provided on the front side of the vehicle body 210. Here, the ore path B is a pit for guiding crushed objects from a tunnel on which crushing operation is conducted to another tunnel provided on a lower layer.

The vehicle body 210 includes a body frame 211 extending in the front-rear direction. The body frame 211 includes a main frame 212 that is substantially frame-shaped in plan view and traveling frames 213 provided on the right and left sides of the main frame 212. A crushing device 214 that is hydraulically driven is mounted on the main frame 212, and a crawler carrier 215 that is also hydraulically driven is provided on each traveling frame 213.

A jaw crusher is used as the crushing device 214 in the second exemplary embodiment. However, the crushing device according to an aspect of the invention is not limited to a jaw crusher, but may be an impact crusher, a cone crusher, a roll crusher or the like.

A discharge port (not shown) of the crushing device 214 is positioned directly above the ore path B, so that crushed objects are inputted directly into the ore path B. Accordingly, the mobile crusher 200 is not provided with a discharge conveyor for conveying crushed objects from the discharge port of the crushing device to the outside of the vehicle body. Since the discharge conveyor is not provided, the crushing device 214 is disposed at a lower position as if being sunk in the main frame 212. More specifically, the discharge port of the crushing device 214 is positioned lower than lower surfaces 213A of the traveling frames 213.

As shown in FIG. 12, the crushing device 214, i.e., the jaw crusher, includes: a fixed jaw 242 provided on a rear frame 241 on the rear side; a swing jaw 243 swingably provided in front of the fixed jaw; and a reaction-force-receiving mechanism 244 provided in front of the swing jaw 243.

Side frames 245 that are plate-shaped are provided on the right and left sides of the crushing device 214. The front portion of the right and left side frames 245 is connected to a cross member 246 included in the reaction-force-receiving mechanism 244, and the rear portion of the side frames 245 is connected to the rear frame 241. Attachment rails 247 horizontally and continuously extend in the front-rear direction on the lateral surfaces of the side frames 245. As shown in FIG. 14, each attachment rail 247 is slidably mounted on a slide surface 212A extending in the front-rear direction on the upper portion of the main frame 212. The attachment rail 247 is also sandwiched between the slide surface 212A and a guide member 212B provided on the upper surface of the main frame 212. Accordingly, the attachment rail 247 is guided by a slide surface 212C on the lower surface of the guide member 212B and the slide surface 212A.

The rear end of horizontal slide cylinder 216 is attached to the rear side of the main frame 212 via a suitable bracket. The front end of the slide cylinder 216 is connected to the lateral surfaces of the side frames 245 of the crushing device 214. The slide cylinder 216 is provided on the right and left sides.

The attachment rails 247 of the crushing device 214 are slid between the slide surfaces 212A and 212C by extending a rod of each slide cylinder 216, so that the crushing device 214 can be slid forwardly as a whole (see dashed-two dotted lines in FIGS. 11 and 12). Conversely, the crushing device 214 can be returned to a predetermined position during crushing operation by retracting the rod. The slide cylinders 216, the attachment rails 247 and the slide surface 212A provide a slide mechanism 248 according to an aspect of the invention. Incidentally, an upper portion 222A of the hopper 222 attached to the feeder unit 220 is provided to overlap the inner side of an upper guide 214A of the crushing device 214 in order to prevent crushed objects from being dropped or fallen out from the crushing device. The crushing device 214 is slid forwardly in order to avoid the interference of the upper portion 222A and the upper guide 214A of the crushing device 214 when the feeder unit 220 swings.

A feeder support 217 extending rearwardly is provided on the rear end of the main frame 212. The feeder unit 220, which is longitudinal in the front-rear direction, is placed on a horizontal upper surface of the feeder support 217. A swing circle 218 serving as a swing unit including an inner race, an outer race and a ball bearing therebetween is provided between the feeder support 217 and the feeder unit 220.

In the feeder unit 220, a hopper 222 is attached to the transfer device 221 that is hydraulically driven. An apron feeder is used as the transfer device 221 in this exemplary embodiment. Rocks mined in tunnels are inputted into the feeder unit 220 and then conveyed to the crushing device 214 provided on the front side to be crushed.

The feeder unit 220 is pivoted on a support frame 223 on the swing circle 218 and is movable upward and downward relative to the support frame 223. The feed unit 20 is moved up and down by the lift cylinder 224. The front end of the lift cylinder 224 is connected to the support frame 223, and the rear end of the lift cylinder 224 is connected to the lower surface of the transfer device 221 substantially in the middle in the front-rear direction.

Accordingly, the rear side of the feeder unit 220 is lifted up by extending a rod of the lift cylinder 224, so that the feeder unit 220 becomes substantially horizontal for traveling from the state where the rear portion of the feeder unit 220 is lowered for crushing operation (sec the dashed-two dotted line in FIG. 11). Since the feeder unit 220 is inclined downwardly during crushing operation, rocks can be inputted at a low position, thus facilitating the crushing operation in the tunnels A.

In this exemplary embodiment, the lift mechanism 227 includes the lift cylinder 224.

As shown in FIG. 11, a leg 225 is attached to the rear portion of the feeder unit 220 so that vertical load applied when rocks are inputted is received directly on a road. The leg 225 is suspended from the lower surface of the feeder unit 220. When the rear portion of the feeder unit 220 is lowered during crushing operation, the leg 225 is rotated with a fixed posture and a lower surface of the leg 225 contacts the road.

The rear end of the main frame 212 of the vehicle body 210 is connected to the support frame 223 provided on the swing circle 218 via a feeder swing cylinder 226. The swing circle 218 is rotated by expansion and contraction of the feeder swing cylinder 226 to swing the feeder unit 220 right and left relative to the vehicle body 210 on a horizontal plane (see the dashed-two dotted line in FIG. 12).

The power unit 230 includes a base frame 231 connected to the main frame 212 of the vehicle body 210. A hydraulic pump 232 for supplying hydraulic pressure to the crushing device 214, carriers 225, transfer device 221, cylinders 216, 224 and 226 is provided on the base frame 231. Further, an electric motor 233 for driving the hydraulic pump 232, a power panel 234 for supplying electric power supplied from the outside via a power cable to the electric motor 233, a hydraulic oil tank 235 for storing hydraulic oil compressively transferred from the hydraulic pump 232, a cooling unit 236 for cooling the hydraulic oil, valves (not shown) for switching the supply of the hydraulic oil to hydraulic devices, and a control panel 237 for controlling various devices are provided on the base frame 231.

The cooling unit 236 includes an oil cooler serving as a heat exchanger for exchanging heat between hydraulic oil and cool air, and a fan for drawing outer air into the oil cooler as cool air. The cooling unit 236 is the tallest among the devices mounted on the base frame 231. This, in the second exemplary embodiment, such a large cooling unit 236 is disposed at a left-side position nearer to the center of the main frame 212 (see FIG. 13). An exterior cover 238 that covers the cooling unit 236 has an inclined surface 238A in order to avoid the interference with the ceiling of the tunnel A.

The mobile crusher 200 of the second exemplary embodiment is an electric crusher including the electric motor 233 as a driving source. An engine is not used as the driving source. Thus, the power unit 230 is provided with a power receiver (not shown) connected to a power cable from electrical supply network in the tunnels A. The supplied electric power is supplied to the electric motor 233 via the power panel 234. However, an engine can be used as the driving source of a hydraulic pump as long as an amount of exhaust gas discharged in tunnels is tolerable.

For example, the engine can be used when a hydraulic pump for supplying hydraulic pressure only to the carriers 215 is separately provided and only this hydraulic pump is driven by the engine. At this time, the engine can be relatively small and does not need to run during crushing operation, so that an amount of exhaust gas discharged from the engine will possibly be tolerable in tunnels. When the electric mobile crusher 200 is moved, a power cable is dragged for supplying electrical power to the electric motor 233. Accordingly, in order to prevent the power cable from damage caused by being dragged, a winder reel is typically attached to the power cable. However, such a power cable is not necessary when a hydraulic supply source for the carriers 215 is driven by an engine. At this time, the damage of the power cable can be prevented and, in addition, the winder reel is not necessary.

Further, hydraulic oil is compressively transferred from the power unit 230 to the transfer device 221 of the feeder unit 220 in order to drive the hydraulic motor of the transfer device 221. A hydraulic line or the like for supplying hydraulic oil is flexibly wired in the vicinity of the feeder support 217 so that the feeder unit 220 can swing.

The movement of the mobile crusher 200 when the mobile crusher 200 travels will be described below.

For moving, the crushing device 214 is initially slid forwardly by extending the slide cylinder 216 in the posture during crushing operation shown in FIG. 11. Next, the lift cylinder 224 is extended to lift up the feeder unit 220, so that the rear portion of the feeder unit 220 is lifted up from a road. In this posture, the mobile crusher 1 can be moved. Incidentally, the mobile crusher 200 is traveled by remote control while an operator attends at the front side or the like thereof.

However, the mobile crusher 1 cannot turn at intersections of tunnels A in the above-described posture because the mobile crusher 1 is too long. Thus, in the exemplary embodiment, the feeder unit 220, i.e., rear unit, swings right and left by extending and retracting the feeder swing cylinder 226 in cornering. Specifically, as shown in FIG. 12, the feeder swing cylinder 226 is extended when the mobile crusher 200 starts to turn left at an intersection after traveling straight. Then, the feeder unit 220 gradually swings toward the left side around the swing circle 218 as shown by an arrow L. When the mobile crusher 200 almost completely turn at the intersection, the feeder swing cylinder 226 is retracted and the feeder unit 220 is returned to its original position, so that the mobile crusher 200 can travel straight again.

The feeder swing cylinder 226 is retracted when the mobile crusher 200 starts to turn right at an intersection and the feeder unit 220 swings toward the right side around the swing circle 218 as shown by an arrow R. When the mobile crusher 200 almost completely turn at the intersection, the feeder swing cylinder 226 is extended and the feeder unit 220 is returned to its original position, so that the mobile crusher 220 can travel straight again.

As described above, the feeder swing cylinder 228 is extended or retracted to swing the feeder unit 220 in cornering, so that the mobile crusher 200 can turn at an intersection with a small turning radius. Even when turning at narrow intersections in tunnels, the mobile crusher 200 can reliably travel.

Third Exemplary Embodiment

In a mobile crusher 300 of the third exemplary embodiment as shown in FIGS. 15 to 17, the support frame 223 supporting the feeder unit 220 is fixed directly to the rear end of the main frame 212. Accordingly, the feeder unit 220 does not swing right or left. Instead, a power unit support 219 is provided on the front end of the main frame 212. The power unit 230 is swingably supported on the power unit support 219 via the swing circle 218 serving as the swing unit.

One end of a power unit swing cylinder 239 is attached to the main frame 212 while the other end of the power unit swing cylinder 239 is attached to the base frame 231 of the power unit 230. The extension and contraction of the power unit swing cylinder 239 swings the power unit 230 relative to the vehicle body 210.

Incidentally, the crushing device 214 does not interfere with the feeder unit 220 because the feeder unit 220 does not swing in the third exemplary embodiment. Thus, a slide mechanism for sliding the crushing device 214 forwardly is not provided to the vehicle body 210. In the crushing device 214, the attachment rails 247 are fixed to the main frame 212 by bolts or the like. Also, in the third exemplary embodiment in which the power unit 230 swings, a hydraulic line for supplying hydraulic pressure to hydraulic motors of the transfer device 221, crushing device 214 and carriers 215 is flexibly wired in the vicinity of the power unit support 219.

The movement of the mobile crusher 300 when the mobile crusher 300 travels will be described below.

For moving, the lift cylinder 224 is initially extended in the posture during crushing operation as shown in FIG. 15 in order to lift up the feeder unit 220 so that the rear portion of the feeder unit 220 is lifted up from a road. In this posture, the mobile crusher 300 can be moved. The mobile crusher 300 is moved by remote control as in the second exemplary embodiment.

In the third exemplary embodiment, the mobile crusher 300 cannot turn at intersections of tunnels A because the mobile crusher 300 is too long. Accordingly, the power unit 230 swings right and left by extending and retracting the power unit swing cylinder 239. Specifically, as shown in FIG. 16, the power unit swing cylinder 239 is retracted when the mobile crusher 300 starts to turn left at an intersection. Then, the power unit 230 gradually swings toward the left side around the swing circle 218 as shown by an arrow L. When the mobile crusher 300 almost completely turn at the intersection, the power unit swing cylinder 239 is extended to return the power unit 230 to its original position, so that the mobile crusher 300 can travel straight again.

The power unit swing cylinder 239 is extended when the mobile crusher 300 starts to turn right at an intersection and the power unit 230 swings toward the right side around the swing circle 218 as shown by an arrow R. When the mobile crusher 300 almost completely turn at the intersection, the power unit swing cylinder 239 is retracted to return the power unit 230 to its original position, so that the mobile crusher 300 can travel straight again.

Since the power unit 230 swings in cornering as described above, the mobile crusher 300 can turn at an intersection with a small turning radius. The mobile crusher 300 can reliably turn even at narrow intersections in tunnels as in the first exemplary embodiment.

Fourth Exemplary Embodiment

In a mobile crusher 400 of the fourth exemplary embodiment as shown in FIGS. 18 and 19, the feeder support 217 is provided on the rear end of the main frame 212 and the power unit support 219 is provided on the front end of the main frame 212. The feeder unit 220 is swingably supported on the feeder support 217 via a swing circle 218R. The power unit 230 is swingably supported on the power unit support 219 via a swing circle 218F. The mobile crusher 400 is provided with the slide mechanism 248 of the crushing device 214 as in the second exemplary embodiment in order to avoid interference with the crushing device 214 while the feeder unit 220 swings. Other arrangements are the same as in the second and third exemplary embodiments.

For moving, the crushing device 214 is initially slid forwardly by extending the slide cylinder 216 in the posture during crushing operation shown in FIG. 18. Then, the lift cylinder 224 is extended to lift the feeder unit 220 up. In this posture, the mobile crusher 400 can be moved. The mobile crusher 400 is moved likewise by remote control.

In turning at intersections of tunnels A, the feeder swing cylinder 226 and the power unit swing cylinder 239 are extended and retracted, so that the feeder unit 220 on the rear side and the power unit 230 on the front side swing right and left. Specifically, as shown in FIG. 19, the power unit swing cylinder 239 is retracted when the mobile crusher 400 starts to turn left at an intersection. Then, the power unit 230 gradually swings toward the left side around the swing circle 218F as shown by an arrow L. When the vehicle body comes close to the corner, the feeder swing cylinder 226 is extended and the feeder unit 220 gradually swings toward the left side around the swing circle 218R. While the vehicle body travels, the power unit swing cylinder 239 is extended to return the power unit 230 to its original position around the swing circle 218F. When the vehicle body almost completely turn at the intersection, the feeder swing cylinder 226 is retracted to return the feeder unit 220 to its original position around the swing circle 218R, so that the mobile crusher 400 can travel straight again.

When the mobile crusher 400 starts to turn right at an intersection, the power unit swing cylinder 239 is extended and the feeder unit 230 gradually swings toward the right side around the swing circle 218F as shown by an arrow R. When the vehicle body comes close to the corner, the feeder swing cylinder 226 is retracted and the feeder unit 220 gradually swings toward the right side around the swing circle 218R. While the vehicle body travels, the power unit swing cylinder 239 is retracted to return the power unit 230 to its original position around the swing circle 218F. When the vehicle body almost completely turn at the intersection, the feeder swing cylinder 226 is extended to return the feeder unit 220 to its original position around the swing circle 218R, so that the mobile crusher 400 can travel straight again.

Since both the feeder unit 220 and the power unit 230 swing in cornering as described above, the mobile crusher 400 can turn at an intersection with an even smaller turning radius. Thus, the mobile crusher 400 can reliably turn even at narrower intersections in tunnels. Incidentally, both or either one of the feeder unit 220 and the power unit 230 can swing depending on intersections. It is not required that both of the feeder unit 220 and the power unit 230 swing.

The best arrangements, methods and the like for carrying out the invention are disclosed above, but the invention is not limited thereto. In other words, while the invention is particularly explained and illustrated mainly in relation to specific embodiments, a person skilled in the art could make various modifications in terms of shape, amount or other particulars to the above-described embodiments without departing from the spirit and scope of the invention.

Therefore, because the above-disclosed description limiting the shape, amount and the like is merely an exemplified statement for facilitating understanding of the invention and is not a limitation on the invention, a statement using names of the members on which a part of or all of the limitations regarding the shape, amount and the like is eliminated is included in the invention.

For example, though the feeder unit 220 and the power unit 230 can swing on a horizontal plane by the swing circle 218 in the second to fourth exemplary embodiments, the swing unit of the invention may be provided by the combination of a circular guide rail and a wheel rotated along the guide rail. When various units and the vehicle body are connected via a vertical connecting pin, the units may swing around the connecting pin via a bush.

The invention claimed is:

1. A mobile crusher that crushes inputted objects and drops the crushed objects directly into an ore path, the mobile crusher comprising:

a crusher vehicle which includes carriers;

a feeder vehicle which includes carriers;

a crushing device for crushing the objects, and which is mounted on the crusher vehicle;

a transfer device for transferring the objects to the crushing device, and which is mounted on the feeder vehicle;

a transferring hydraulic motor which is provided in the feeder vehicle, and which drives the transfer device; and a transferring hydraulic pump which is provided in the crusher vehicle, and which supplies hydraulic pressure to the transferring hydraulic motor;

wherein the crusher vehicle and the feeder vehicle travel independently and include a crusher-side connecting portion and a feeder-side connecting portion connected to each other, the crusher vehicle and the feeder vehicle being disposed anteriorly and posteriorly to the ore path during a crushing operation, and wherein the crushing device is disposed on the crusher vehicle near an end of the crusher vehicle facing the feeder vehicle so as to be disposed above the ore path during the crushing operation.

2. The mobile crusher according to claim 1, wherein a chute is provided between the crusher vehicle and the feeder vehicle and is attached to one of the crusher vehicle and the feeder vehicle, and the chute extends from a lower portion of the transfer device toward the ore path.

3. The mobile crusher according to claim 1, wherein a positioning unit is provided on the crusher-side connecting portion and the feeder-side connecting portion for positioning the crusher vehicle and the feeder vehicle.

4. The mobile crusher according to claim 3, wherein the positioning unit includes:

a guide pin which is provided on one of the crusher-side connecting portion and the feeder-side connecting portion, and which protrudes toward the other one of the crusher-side connecting portion and the feeder-side connecting portion; and a guide hole which is provided on the other one of the crusher-side connecting portion and the feeder-side connecting portion, the guide pin being inserted into the guide hole.

5. The mobile crusher according to claim 3, wherein the positioning unit includes:

a light-emitting device provided on one of the crusher-side connecting portion and the feeder-side connecting portion for emitting light toward the other one of the crusher-side connecting portion and the feeder-side connecting portion; and a target portion for receiving the light emitted from the light-emitting device, and which is provided on the other one of the crusher-side connecting portion and the feeder-side connecting portion.

6. The mobile crusher according to claim 1, wherein:

the feeder vehicle includes the carriers on right and left sides, and the transfer device is positioned so that a base end thereof close to an input port of the objects is positioned as high as the carriers, the transfer device being inclined upwardly toward a distal end thereof.

7. The mobile crusher according to claim 6, wherein:

the feeder vehicle includes a body frame, and the transfer device is rotatably pivoted on the body frame by a rotary shaft horizontally orthogonal to the front-rear direction, the transfer device being connected to the body frame via a lift cylinder.

8. The mobile crusher according to claim 7, wherein the feeder vehicle includes:

a traveling hydraulic motor that drives the carriers;

a traveling hydraulic pump for supplying hydraulic pressure to the traveling hydraulic motor and the lift cylinder; and an engine that drives the traveling hydraulic pump, the engine is provided between the carries provided on the right and left sides, and at least two of a fuel tank for storing fuel for the engine, a hydraulic oil tank for storing hydraulic oil compressively transferred to the traveling hydraulic motor and the lift cylinder, a control panel and a battery are separately provided on upper portions of the carriers on the right and left sides.

9. The mobile crusher according to claim 8, wherein:

in the feeder vehicle, at least two of the fuel tank for storing fuel for the engine, the hydraulic oil tank for storing hydraulic oil compressively transferred to the traveling hydraulic motor, the control panel and the battery are separately provided on the upper portions of the carriers on the right and left sides, and eaves that cover devices disposed on the upper portions of the carriers are provided on a hopper at a position close to the input port of the objects of the transfer device.

10. The mobile crusher according to claim 9, wherein:

the eaves are integrated with the hopper on the right and left sides, and at least the eaves are partially inclined downwardly as they extend outwardly on the right and left sides.

11. The mobile crusher according to claim 1, wherein:

the crusher vehicle includes a jaw crusher as the crushing device, a discharge port of the jaw crusher is positioned lower than a lowermost surface of a body frame on which the jaw crusher is mounted, an upper portion of a flywheel provided on the jaw crusher is positioned lower than an upper end of a swing jaw of the jaw crusher, and the jaw crusher is disposed so that a tooth flank of a fixed jaw is vertical to the body frame.

12. The mobile crusher according to claim 11, wherein the crusher vehicle includes a crushing hydraulic motor that drives the jaw crusher.

13. The mobile crusher according to claim 12, wherein the crusher vehicle includes:

a crushing hydraulic pump for supplying hydraulic pressure to the crushing hydraulic motor;

an electric motor that drives the crushing hydraulic pump;

a traveling hydraulic motor that drives the carriers of the crusher vehicle;

a traveling hydraulic pump for supplying hydraulic pressure to the traveling hydraulic motor; and an engine that drives the traveling hydraulic pump.

14. The mobile crusher according to claim 12, wherein:

a cooling unit that cools hydraulic oil for driving the crushing hydraulic motor is provided on the crusher vehicle, and at least the cooling unit is provided close to a center of the crusher vehicle in a width direction thereof.

* * * * *